US006869647B2

(12) United States Patent
Page et al.

(10) Patent No.: US 6,869,647 B2
(45) Date of Patent: Mar. 22, 2005

(54) PRINT MEDIA PRODUCTS FOR GENERATING HIGH QUALITY, WATER-FAST IMAGES AND METHODS FOR MAKING THE SAME

(75) Inventors: Loretta Ann Grezzo Page, San Diego, CA (US); Richard J. McManus, San Diego, CA (US)

(73) Assignee: Hewlett-Packard Development Company L.P., Houston, TX (US)

( * ) Notice: Subject to any disclaimer, the term of this patent is extended or adjusted under 35 U.S.C. 154(b) by 143 days.

(21) Appl. No.: 09/944,177

(22) Filed: Aug. 30, 2001

(65) Prior Publication Data

US 2003/0049417 A1 Mar. 13, 2003

(51) Int. Cl.[7] ..... B41M 5/40

(52) U.S. Cl. ..... 428/32.29; 428/32.3; 428/32.34; 428/32.38; 524/399; 524/555; 427/243

(58) Field of Search ..... 428/32.29, 32.3, 428/32.34, 32.38, 195, 474.4, 422, 500, 521, 522; 524/399, 555; 427/243

(56) References Cited

U.S. PATENT DOCUMENTS

| | | | | |
|---|---|---|---|---|
| 4,391,850 | A | | 7/1983 | Shanton |
| 4,440,827 | A | | 4/1984 | Miyamoto et al. |
| 4,446,174 | A | | 5/1984 | Maekawa et al. |
| 4,474,847 | A | | 10/1984 | Schröder et al. |
| 4,567,096 | A | | 1/1986 | Piltingsrud et al. |
| 4,623,557 | A | | 11/1986 | Yamori et al. |
| 4,642,247 | A | | 2/1987 | Mouri et al. |
| 4,707,406 | A | | 11/1987 | Inaba et al. |
| 4,780,356 | A | | 10/1988 | Otouma et al. |
| 4,785,313 | A | | 11/1988 | Higuma et al. |
| 4,879,166 | A | | 11/1989 | Misuda et al. |
| 4,892,787 | A | | 1/1990 | Kruse et al. |
| 4,963,189 | A | | 10/1990 | Hindagolla |
| 5,008,231 | A | | 4/1991 | Yoshizawa et al. |
| 5,013,603 | A | | 5/1991 | Ogawa et al. |
| 5,075,153 | A | | 12/1991 | Malhotra |
| 5,091,359 | A | | 2/1992 | Ishida et al. |
| 5,093,159 | A | | 3/1992 | Fernandez et al. |
| 5,104,730 | A | | 4/1992 | Misuda et al. |
| 5,185,034 | A | | 2/1993 | Webb et al. |
| 5,194,347 | A | | 3/1993 | Vermeulen et al. |
| 5,264,275 | A | | 11/1993 | Misuda et al. |
| 5,266,383 | A | | 11/1993 | Sakaki et al. |
| 5,270,103 | A | * | 12/1993 | Olver et al. ..... 428/219 |
| 5,312,863 | A | | 5/1994 | Van Rheenen et al. |
| 5,354,634 | A | | 10/1994 | Misuda et al. |
| 5,397,619 | A | | 3/1995 | Kuroyama et al. |
| 5,397,674 | A | | 3/1995 | Ozaki et al. |
| 5,428,383 | A | | 6/1995 | Shields et al. |
| 5,463,178 | A | | 10/1995 | Suzuki et al. |
| 5,472,773 | A | | 12/1995 | Misuda et al. |
| 5,514,636 | A | | 5/1996 | Takeuchi |
| 5,515,093 | A | | 5/1996 | Haruta et al. |
| 5,576,088 | A | | 11/1996 | Ogawa et al. |
| 5,605,750 | A | | 2/1997 | Romano et al. |
| 5,609,964 | A | | 3/1997 | Ogawa et al. |
| 5,635,297 | A | | 6/1997 | Ogawa et al. |
| 5,665,504 | A | | 9/1997 | Malhotra |
| 5,691,046 | A | | 11/1997 | Matsubara et al. |
| 5,723,211 | A | | 3/1998 | Romano et al. |
| 5,728,427 | A | | 3/1998 | Akkerman et al. |
| 5,744,273 | A | | 4/1998 | Malhotra |
| 5,753,588 | A | | 5/1998 | Iida et al. |
| 5,755,929 | A | | 5/1998 | Kuroyama et al. |
| 5,759,727 | A | | 6/1998 | Malhotra |
| 5,798,397 | A | | 8/1998 | Noguchi et al. |
| 5,804,293 | A | * | 9/1998 | Nehmsmann et al. .... 428/307.3 |
| 5,837,649 | A | | 11/1998 | Nozaki |
| 5,846,637 | A | | 12/1998 | Malhotra et al. |
| 5,863,648 | A | | 1/1999 | Ohmura et al. |
| 5,880,196 | A | | 3/1999 | Cho et al. |
| 5,882,388 | A | | 3/1999 | Adair et al. |
| 5,888,367 | A | | 3/1999 | Mouri et al. |
| 5,897,961 | A | | 4/1999 | Malhotra et al. |
| 5,912,071 | A | | 6/1999 | Takeshita et al. |
| 5,916,673 | A | | 6/1999 | Fryberg et al. |
| 5,919,552 | A | | 7/1999 | Malhotra |
| 5,928,789 | A | | 7/1999 | Chen et al. |
| 5,962,124 | A | | 10/1999 | Yoshino et al. |
| 5,965,244 | A | | 10/1999 | Tang et al. |
| 5,977,019 | A | | 11/1999 | Ozeki et al. |
| 5,985,076 | A | | 11/1999 | Misuda et al. |
| 6,040,060 | A | | 3/2000 | Missel et al. |
| 6,063,489 | A | | 5/2000 | Kobayashi et al. |
| 6,086,738 | A | | 7/2000 | Mouri et al. |
| 6,089,704 | A | | 7/2000 | Burns et al. |
| 6,197,880 | B1 | | 3/2001 | Nigam |
| 6,214,449 | B1 | | 4/2001 | Otani et al. |
| 6,365,264 | B2 | * | 4/2002 | Darsillo et al. ..... 428/195 |
| 6,419,355 | B1 | * | 7/2002 | Bermel et al. ..... 347/105 |
| 2002/0182375 | A1 | * | 12/2002 | Kashiwazaki et al. ..... 428/195 |
| 2002/0187311 | A1 | * | 12/2002 | Golub et al. ..... 428/195 |
| 2003/0153666 | A1 | * | 8/2003 | Farooq ..... 524/430 |
| 2003/0174195 | A1 | * | 9/2003 | Onishi et al. ..... 347/105 |

FOREIGN PATENT DOCUMENTS

| | | |
|---|---|---|
| JP | 10-181189 | 12/1996 |
| WO | WO 00/71359 | 11/2000 |
| WO | WO 01/43978 | 6/2001 |

OTHER PUBLICATIONS

Material Data Sheets from Rohm & Haas Company regarding PRIMAL®PR–26.

* cited by examiner

*Primary Examiner*—B. Shewareged

(57) ABSTRACT

Ink-receiving print media products having multiple capabilities including (A) minimal drying time; (B) improved smear-fastness; (C) a high level of water-fastness; (D) the ability to generate high-definition images; and (E) excellent ink compatibility. The media products have at least one ink-receiving layer on a substrate (e.g. paper pre-coated with one or more binders and/or pigments). The ink-receiving layer includes a pigment (boehmite, pseudo-boehmite, or mixtures thereof) optimally combined with a special binder blend [polyvinyl alcohol, a poly(vinyl acetate-ethylene) copolymer, and a poly(vinyl pyrrolidone-vinyl acetate) copolymer]. Also included is a special dye fixative (namely, a cationic emulsion polymer) which provides enhanced water-fastness. This fixative is of a particular type (a quaternary amine) that also allows high pigment levels to be employed (at least about 65% by weight) which further promotes the foregoing benefits.

21 Claims, 2 Drawing Sheets

PRINT MEDIA PRODUCTS FOR GENERATING HIGH QUALITY, WATER-FAST IMAGES AND METHODS FOR MAKING THE SAME

BACKGROUND OF THE INVENTION

The present invention generally relates to media products for receiving printed images thereon. More particularly, the invention described herein involves image-receiving sheet materials each having at least one ink-receiving layer with specialized and distinctive ingredients therein that provide a number of important benefits. These benefits include but are not limited to a high degree of compatibility between the ink materials being delivered and the ink-receiving layer under consideration, rapid drying times, a high level of water-fastness, the generation of smear-fast printed images, the control of ink-coalescence (defined below), the attainment of uniform gloss levels, a desirable level of consistency regarding the overall surface characteristics of the media products, along with other benefits relating to image quality. As will be discussed herein, these benefits are simultaneously achieved in the present invention through the use of some very special material combinations including but not limited to carefully-chosen pigment compounds, a specially-selected group of binders employed in combination, and the incorporation of a distinctive ink fixative (e.g. ink fixing agent) which is especially compatible with the chosen pigment(s). Further information regarding these important characteristics will be presented in greater detail below.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in, for example, U.S. Pat. No. 4,771,295 to Baker et al. and U.S. Pat. No. 5,278,584 to Keefe et al. which are both incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit is provided at a remote location within the printer, with the ink containment unit being operatively connected to and in fluid communication with the printhead using one or more ink transfer conduits. These particular systems are conventionally known as "off-axis" printing units. A representative, non-limiting off-axis ink delivery system is discussed in, for example, U.S. Pat. No. 5,975,686 to Hauck et al. which is also incorporated herein by reference. The present invention as described below (which involves a plurality of novel ink-receiving print media products) is applicable to both on-board and off-axis systems (as well as any other types which include at least one ink containment vessel that is either directly or remotely in fluid communication with a printhead containing one or more ink-ejecting resistors therein). Furthermore, while the print media materials outlined herein will be discussed with primary reference to thermal inkjet technology, it shall be understood that they may be employed in connection with other ink delivery systems and methods including but not limited to piezoelectric drop devices of the variety disclosed in U.S. Pat. No. 4,329,698 to Smith and dot matrix units of the type described in U.S. Pat. No. 4,749,291 to Kobayashi et al., as well as other comparable and diverse systems designed to deliver ink using one or more ink delivery components and assemblies. In this regard, the claimed print media products and methods shall not be considered "print method-specific" or "ink-specific".

In order to effectively generate printed images using the various ink transfer techniques and systems discussed herein (again, with primary but not necessarily exclusive reference to thermal inkjet technology), ink-receiving print media materials must be employed which are capable of efficiently accomplishing this goal. Ideally, to achieve maximum efficiency, print media materials should be able to provide numerous advantages and benefits including but not limited to (1) a high level of light-fastness, with the term "light-fastness" being generally defined herein to involve the capacity of a print media product to retain images thereon in a stable fashion without substantial fading, blurring, distortion, and the like over time in the presence of natural or made-made light; (2) rapid drying times in order to avoid smudging and image deterioration immediately after printing is completed due to contact with physical objects and the like; (3) the fast and complete absorption of ink materials in a manner which avoids image distortion caused by color bleed (namely, the undesired migration of multi-colored ink components into each other) and related difficulties; (4) a highly water-fast character (with the term "water-fast" being generally defined to involve the ability of a print media product to produce a stable image with little or no fading, run-off, distortion, and the like when the image is placed in contact with moisture); (5) the generation of "crisp" images with a distinct and defined character; (6) the ability to produce printed products which are substantially "smear-fast", with this term being generally defined to comprise the production of images that will not exhibit smearing, blurring, and the like when rubbed or otherwise physically engaged with a variety of objects ranging from the components of the printing apparatus being employed to the print operator's hands, fingers, and the like; (7) the control of an undesired condition known as "ink-coalescence" which is defined herein to involve a phenomenon wherein wet ink droplets applied to a printing medium fail to spread sufficiently to eliminate the unprinted (e.g. open) space between the droplets, thereby causing significant image deterioration problems; (8) the capacity to generate printed images with desired levels of gloss wherein the final product is characterized by uniform gloss levels throughout the entire image in order to achieve a professional and aesthetically-pleasing printed media sheet; (9) the ability to attain a high level of consistency during large-scale production regarding the overall surface characteristics of the completed media products; (10) low material costs which enable the print media products of interest to be employed for mass market home and business use; (11) chemical compatibility with a wide variety of ink formulations which leads to greater overall versatility; (12) excellent levels of image stability and retention over long time periods; (13) minimal complexity from a production, material-content, and layer-number standpoint (with as few required layers as possible being desirable) which leads to reduced fabrication costs and greater product reliability; and (14) a high level of gloss-control which is achievable in a rapid and effective manner during production through only minor adjustments in the manufacturing process. The term "gloss-control" is generally defined herein to involve the ability, during fabrication, to generate a print media product having high-gloss levels for the production of photographic quality images if desired, a semi-gloss character if needed, or other gloss parameters. In particular, the manufacturing process should be highly controllable in order to achieve a variety of different gloss characteristics without requiring major adjustments in processing steps and materials.

In the past, many different print media sheets using a wide variety of ingredients, production techniques, layering arrangements, and the like have been fabricated for a multitude of specific purposes. For example, as generally discussed in the representative patent documents listed below, the following items have been investigated and/or employed in the manufacture of print media products to achieve a broad spectrum of goals: modifications in the types of materials being used, the amounts of such materials, the relative particle sizes thereof, the particular layering arrangements being chosen, the specific combinations of ingredients being selected for layer-formation (e.g. binders, pigments, fillers, and/or other ingredients), and the adjustment of various factors including pore size, pore volume, layer thickness, particle orientation, surface roughness, surface rigidity, air permeability, and numerous other parameters. Representative patents (incorporated herein by reference) which discuss at least one or more of the above-listed factors (and/or others) are as follows: U.S. Pat. Nos. 4,391,850; 4,440,827; 4,446,174; 4,474,847; 4,567,096; 4,623,557; 4,642,247; 4,707,406; 4,780,356; 4,785,313; 4,879,166; 4,892,787; 5,008,231; 5,013,603; 5,075,153; 5,091,359; 5,093,159; 5,104,730; 5,194,347; 5,264,275; 5,266,383; 5,354,634; 5,397,619; 5,397,674; 5,463,178; 5,472,773; 5,514,636; 5,515,093; 5,665,504; 5,576,088; 5,605,750; 5,609,964; 5,635,297; 5,691,046; 5,723,211; 5,728,427; 5,744,273; 5,753,588; 5,755,929; 5,759,727; 5,798,397; 5,804,293; 5,846,637; 5,863,648; 5,882,388; 5,888,367; 5,897,961; 5,912,071; 5,916,673; 5,919,552; 5,928,789; 5,962,124; 5,965,244; 5,977,019; 5,985,076; 6,040,060; 6,063,489; 6,086,738; 6,089,704; 6,197,880; and 6,214,449.

Notwithstanding the various media products discussed in the above-listed patents and prior activities in this field, a need remains for print media materials (namely, ink-receiving sheets) which are able to capture and retain clear, distinct, and accurate images thereon that are likewise characterized by a number of specific benefits in combination. These benefits include but are not limited to items [1]–[14] recited above both on an individual and simultaneous basis in a substantially automatic manner (with the simultaneous achievement of such goals being of particular importance and novelty). The attainment of these objectives is especially important regarding the following specific items: water-fastness (with particular reference to the achievement of this goal in a pigment system containing boehmite, pseudo-boehmite, or a mixture thereof), excellent light-fastness, rapid drying time, an effective level of ink-coalescence control, and the generation of clear, durable, smear-fast, and distinct printed images. The present invention and its various embodiments perform all of the functions recited above in a uniquely effective and simultaneous manner while using a minimal number of material layers, chemical compositions, and production steps. In particular (as will become readily apparent from the discussion provided herein), the foregoing advantages and attributes are achieved through the employment of at least one ink-receiving layer having some very special ingredient combinations therein, the use of which in a print media product is entirely novel and offers the above-listed benefits. As a result, print media structures of minimal complexity are created that nonetheless exhibit a substantial number of beneficial characteristics and features in an unexpectedly efficient fashion. In this regard, the present invention represents a distinctive and important advance in the print media and image generation fields. Specific information concerning the novel print media materials of the invention and specialized fabrication methods associated therewith (which are equally unique) will be presented below in the following Summary of the Invention, Brief Description of the Drawings, and Detailed Description of Preferred Embodiments Sections.

SUMMARY OF THE INVENTION

It is an object of the present invention to provide highly efficient print media products for receiving inks, pigments, toners, and other colorants thereon so that a printed image may be generated.

It is another object of the invention to provide highly efficient print media products which enable the generation of stable printed images thereon from a variety of different coloring agents in many divergent forms.

It is another object of the invention to provide highly efficient print media products which facilitate the generation of printed images that have excellent water-fastness characteristics as previously defined.

It is another object of the invention to provide highly efficient print media products which likewise have a high pigment content therein (e.g. at least about 65% by weight or more with particular reference to the use of a material selected from the group consisting of boehmite, pseudo-boehmite, and a mixture thereof) yet are still water-fast as previously indicated.

It is another object of the invention to provide highly efficient print media products which facilitate the generation of printed images that are light-fast as defined above.

It is another object of the invention to provide highly efficient print media products wherein the printed images produced thereon may be generated using a wide variety of printing technologies including but not limited to those which employ thermal inkjet technology.

It is another object of the invention to provide highly efficient print media products which are able to retain printed images thereon that exhibit an excellent degree of stability (including the avoidance of color bleed, namely, the undesired blending of colorants into each other) over prolonged time periods and under conditions of varying temperature, humidity, and the like.

It is another object of the invention to provide highly efficient print media products wherein the printed images hereon are characterized by rapid drying times.

It is another object of the invention to provide highly efficient print media products wherein the printed images thereon are substantially smear-fast when placed in contact with physical objects under a wide variety of environmental conditions.

It is another object of the invention to provide highly efficient print media products which avoid problems associated with ink-coalescence so that clear and distinct printed images can be generated.

It is another object of the invention to provide highly efficient print media products which have the capacity to generate printed images with desired levels of gloss (e.g. semi-gloss and the like) wherein the final printed image is characterized by uniform gloss levels throughout the entire image plane in order to achieve a professional and aesthetically-pleasing printed media sheet of maximum utility.

It is another object of the invention to provide highly efficient print media products wherein a high solids-content can be employed (again using large quantities of pigment materials including but not limited to boehmite, pseudo-boehmite, or a mixture thereof) which are likewise characterized by the absence of problems involving excessive viscosification (e.g. viscosity increases) and/or gellation of the pigment(s).

It is another object of the invention to provide highly efficient print media products which are able to effectively accomplish all of the above-listed goals and others (including the generation of images that are substantially water-fast and highly-defined) in a simultaneous fashion, with this aspect of the invention being accomplished in accordance with the unique layering arrangements and/or chosen construction materials discussed herein.

It is a further object of the invention to provide highly efficient print media products which are able to effectively accomplish all of the above-listed goals using a minimal number of ingredients and material layers (optimally a single ink-receiving layer).

It is an even further object of the invention to provide highly efficient print media products which employ layering arrangements and construction materials that are readily suited to large scale mass-production fabrication processes in an economical fashion.

It is an even further object of the invention to provide highly efficient print media products that are readily used in a wide variety of different printing systems with differing colorants (e.g. inks, pigments, toners, and the like) for many diverse purposes.

It is a still further object of the invention to provide highly efficient, rapid, and economical manufacturing methods which may be employed to produce the print media products of the present invention as discussed herein.

Novel and effective print media products (also characterized herein as "print media sheets", "ink-receiving sheets", "ink-receiving substrates", "ink-receiving members", and the like) are described below which offer numerous advantages and benefits over prior structures. These benefits and advantages include, without limitation, the simultaneous achievement of items [1]–[14] recited above with particular reference to (A) a high level of water-fastness; (B) excellent light-fastness; (C) rapid drying time; (D) a high degree of ink-coalescence control; (E) the ability to precisely control the surface characteristics of the print media products in a uniform and consistent manner including gloss parameters and the like; (F) the generation of clear, durable, smear-fast, and distinct printed images using a minimal quantity of materials and layers; and (G) the employment of high pigment levels (with particular reference to the use of boehmite, pseudo-boehmite, or a mixture thereof) in order to achieve increased porosity and ink-absorbing capacity while avoiding problems associated with excessive pigment gellation and undesired viscosity increases. In this regard, the claimed invention represents a significant advance in the print media technology and image generation fields.

As a preliminary point of information, the present invention shall not be restricted to any particular component types, sizes, material-selections, arrangements of print media materials, chemical compositions, layering sequences, numbers of layers, layer orientations, thickness values, porosity parameters, and other related factors unless otherwise expressly stated herein. For example, it shall be understood that one or a plurality of novel ink-receiving layers containing the desired and special ingredient combinations discussed below may be employed in connection with the claimed media sheets. In this regard, the current invention shall not be restricted to any number of layers containing the chosen ingredient formulations provided that at least one of such layers is used. Likewise, the location of the ink-receiving layer(s) of interest on or within the media sheet(s) may be varied as desired and employed in combination with one or more other material layers located above or below the claimed layer(s) of concern. It should therefore be emphasized that this invention shall cover the ink-receiving layer or layers of interest (namely, those that employ the special ingredient combinations specified herein) regardless of where such layer(s) are located provided that they are able to receive on or within at least part of the ink compositions being delivered by the chosen printing system. Accordingly, this invention shall be construed in its broadest sense to cover a print media product (and method for producing the same) which employs at least one ink-receiving layer having the claimed ingredient combinations therein so that this layer can receive at least part of the ink materials being delivered. Such special ingredient combinations include but are not limited to: (1) the employment of one or more pigments (preferably boehmite, pseudo-boehmite, or a mixture of boehmite and pseudo-boehmite) combined with a novel binder blend (e.g. mixture or combination) which includes at least [i] a first binder composition [e.g. polyvinyl alcohol]; [ii] a second binder composition [e.g. a poly(vinyl acetate-ethylene) copolymer]; and [iii] a third binder composition [e.g. a poly(vinyl pyrrolidone-vinyl acetate) copolymer], with the binder blend optionally including other binders therein; (2) the use of a pigment (optimally boehmite, pseudo-boehmite, or a mixture thereof) in a large quantity (preferably at least about 65% by weight or more of the ink-receiving layer) in combination with a special ink fixative (e.g. a cationic emulsion polymer as outlined further below) which is highly compatible with the pigment that enables the above-listed benefits to be achieved; and (3) a combination of items [1] and [2] listed above as well as other ingredient mixtures which will be discussed in considerable detail below. By using the novel and unique technologies outlined herein, a printed image can be generated having the desired characteristics recited throughout this discussion.

Furthermore, the numerical values listed in this section and in the other sections set forth below constitute preferred embodiments designed to provide optimum results and shall not limit the invention in any respect. In particular, it shall be understood that the specific embodiments discussed herein and illustrated in all of the drawing figures (along with the particular construction materials associated therewith) constitute special versions of the invention which, while non-limiting in nature, can offer excellent results and are highly distinctive. All recitations of chemical formulae and structures set forth in the following discussion are intended to generally indicate the types of materials which may be used in this invention. The listing of specific chemical compositions which fall within the general formulae and classifications presented below are offered for example purposes only and shall be considered non-limiting unless explicitly stated otherwise.

The claimed invention and its novel developments are applicable to a wide variety of printing systems with particular reference to those that employ thermal inkjet technology as previously discussed. Likewise, a number of different ink materials can be used in connection with the invention without limitation, with the term "ink materials" being defined to encompass compositions incorporating dyes, pigments, liquid or solid toners, and other colorants without restriction. Furthermore, such materials (e.g. colorants) shall encompass both chromatic (e.g. colored) and achromatic materials (black/white) without restriction. In this regard, the claimed print media products shall not be considered "ink-specific" or "printing method-specific" in any fashion.

It should also be understood that the present invention shall not be limited to any particular construction techniques (including any given material deposition procedures, layering arrangements, and the like) unless otherwise stated below. For example, the terms "forming", "applying", "delivering", "placing", "positioning", "operatively attaching", "operatively connecting", "converting", "providing", "layering", and grammatical variants thereof as used throughout this discussion and as claimed shall broadly encompass any appropriate manufacturing procedures including, without limitation, roll-coating, spray-coating, immersion-coating, cast-coating, slot-die coating, curtain coating, rod-coating, blade-coating, roller application, manual or automatic dipping, brush-coating, and other related production methods. In this regard, the invention shall not be considered "production method-specific" unless otherwise stated herein, with the recitation of any particular fabrication techniques, layer deposition methods, number of layers applied in a given step, layer orientations, and the like being set forth for example purposes only.

Likewise, it shall be understood that the terms "operative connection", "operative attachment", "in operative connection", "in operative attachment", "operatively attached", "positioned on", "located on", "positioned above", "layered on", "positioned over and above", "located over and above", "applied over and above", "formed over and above", and the like as used and claimed herein shall be broadly construed to encompass a variety of divergent layering arrangements and assembly techniques. These arrangements and techniques include but are not limited to (1) the direct attachment of one material layer to another material layer with no intervening material layers therebetween; and (2) the attachment of one material layer to another material layer with one or more material layers therebetween provided that the one layer being "attached to", "connected to", or "positioned over and above" the other layer is somehow "supported" by the other layer (notwithstanding the presence of one or more additional material layers therebetween). Use of the phrase "direct attachment", "directly attached on", "directly attached to", "directly positioned on", "directly located on", and the like shall signify a situation wherein a given material layer is secured to another material layer without any intervening material layers therebetween. Any statement used herein which indicates that one layer of material is "above", "over", "positioned over and above", or "on top of" another layer shall involve a situation wherein the particular layer that is "above", "over", "positioned over and above", or "on top of" of the other layer in question shall be the outermost of the two layers relative to the external environment. The opposite situation will be applicable regarding use of the terms "below", "under", "beneath", "on the bottom of", and the like. The characterizations recited above (with particular reference to "positioned over and above") shall be effective regardless of the orientation of the print media materials under consideration and, for example, shall encompass a situation where the ink-receiving layer of interest may be placed on either side of the substrate in question. Again, in the current invention, the claimed ink-receiving layer or layers may be located at any position within the print media sheet provided that at least some of the ink materials being delivered by the chosen printing system are able to come in contact with such layer or layers, followed by the receipt of ink materials therein and/or thereon. Thus, while the drawing figures associated with this invention (and the preferred embodiments discussed below) shall illustrate the claimed ink-receiving layer(s) on top of the media sheet as the uppermost/outermost structures which are exposed to the external environment with no other layers thereon, the claimed invention shall not be restricted to this design which is offered for example purposes only. In this regard, one or more other layers of material may be placed over or under the ink-receiving layers of interest in accordance with the explanation provided above.

As an additional point of information, the terms "top", "uppermost", and "outermost" as applied to a given layer in the claimed structure shall again be construed to involve that layer which is at the top of the print media product in question with no other layers thereon and is exposed to the external environment. When such layer faces the ink delivery components of the printer unit, it is typically the first component of the media product to receive incoming ink materials with no other layers thereon. Likewise, any indication herein and/or in the claims regarding a given layer being located "over and above" (or some other equivalent phrase) the substrate under consideration shall signify a situation where the layer of concern is positioned over (e.g. on top of) the substrate either directly with no intervening layers being present or with one or more intervening layers therebetween. In other words, the foregoing phrase (e.g. "over and above" and equivalents thereto) as it applies to a given layer shall be construed to involve a situation where such layer is somehow above the substrate (e.g. outermost as previously defined relative to the substrate) whether or not any intervening layers are located between the substrate and the layer of concern.

Furthermore, any indication that the ink-receiving layer(s) (or other layers set forth herein) are somehow "supported" by the substrate under consideration (whether coated or uncoated as outlined below) shall signify a situation where the layer(s) in question reside on the substrate and are directly attached thereto as previously defined or indirectly attached thereto with one or more layers therebetween. In such a situation, the layer(s) of concern rely on the substrate for structural support.

Any and all recitations of structures, layers, materials, and components in the singular throughout the claims, Summary of the Invention, and Detailed Description of Preferred Embodiments sections shall also be construed to encompass a plurality of such items unless otherwise specifically noted herein. Likewise, employment of the phrase "at least one" shall be construed in a conventional fashion to involve "one or more" of the listed items, with the term "at least about" being defined to encompass the listed numerical value and values in excess thereof. Employment of the word "about"

in connection with any numerical terms recited herein shall be construed to offer at least some latitude both above and below the listed parameter with the magnitude thereof being construed in accordance with current and applicable legal decisions pertaining to this terminology.

As previously indicated, highly effective and versatile print media materials designed to receive ink materials thereon for the generation of clear, stable, water-fast, and distinct printed images are provided. These media materials are again characterized by uniform surface/gloss characteristics, a desirable degree of ink-coalescence control and compatibility, and a high level of image stability from a water-fastness and smear-fastness standpoint as previously defined. Many different ink delivery systems can be employed to generate the printed images of interest on the claimed media products without limitation although the use of devices that incorporate thermal inkjet technology are again preferred. Regardless of which ink delivery system is chosen, the present invention is capable of offering the considerable benefits listed above which include more efficient, rapid, and reliable image generation.

The following discussion shall constitute a brief and general overview of the invention which shall not be limiting in any respect. More specific details concerning particular embodiments and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

In order to produce a preferred print media product in accordance with the invention, a substrate (also known as a "support", "support structure", "base member", and the like with all of such terms being considered equivalent from a structural and functional standpoint) is initially provided on which the other layer or layers associated with the print media product reside. Many different construction materials can be employed in connection with the substrate including those which are made from paper, plastics, metals, or composites of such materials without limitation although paper (any commercially-available type) is preferred. More detailed data regarding substrate construction materials will be presented below. The chosen substrate may be coated or uncoated on either or both sides thereof. In a preferred and non-limiting embodiment designed to provide optimum results, the substrate is produced from a sheet or portion of cellulosic (preferred) or synthetic (non-cellulosic) paper having an upper surface (also characterized herein as a "first side") and a lower surface (also characterized herein as a "second side"). This particular paper substrate can be used in an uncoated or "bare" state or, in the alternative, at least one of such surfaces/sides (preferably the upper surface or both surfaces) can be covered with at least one coating layer (or multiple coating layers which are identical or different from each other if desired). The chosen coating layer of interest can contain a non-absorbent and ink-impermeable composition such as polyethylene which is of particular value when a paper substrate is employed. However, other coating/substrate combinations can be used without limitation or the application of substrate coatings can be eliminated entirely if desired as determined by routine preliminary pilot testing. Regarding alternative coating compositions in connection with the substrate (especially when made of paper), such compositions can involve combinations of various ingredients including but not limited to at least one or more pigments, binders, fillers, and selected "supplemental ingredients" such as defoamer compositions (e.g. surfactants), biocides, buffers, slip agents, preservatives (e.g. antioxidants), light/UV stabilizers, and the like without restriction. In this regard, it should be understood that the present invention shall not be limited to any given substrate whether coated or uncoated.

Positioned (e.g. provided) over and above the coated or uncoated substrate (and secured thereto with "direct attachment" being preferred but not necessarily required) is at least one "ink-receiving layer". The ink-receiving layer is "supported" by the substrate, with such term being defined above. From a functional standpoint, the ink-receiving layer is designed to provide a high degree of "capacity" (e.g. ink-retention capability) in connection with the media product, to facilitate rapid drying of the printed, image-containing media product, to create a media product with a smooth/even surface, to ensure that the desired gloss characteristics are maintained in the finished product (preferably "semi-gloss" in the current situation), and to generate a stable printed image with desirable degrees of water-fastness, light-fastness, smear-fastness, ink-coalescence control, and the like. To accomplish these goals, the ink-receiving layer is comprised of special material combinations which have numerous functional attributes including but not limited to excellent binding capabilities, ink-absorptivity, the capacity to affix and retain printed images in a highly stable and water-fast manner, and the like. The materials and combinations associated with the ink-receiving layer will now be briefly summarized.

First, at least one pigment composition is provided. While it is possible to use a number of different pigments for this purpose as outlined in the Detailed Description of Preferred Embodiments section, a preferred composition suitable for this purpose will involve a material selected from the group consisting of boehmite, pseudo-boehmite, and a mixture thereof (e.g. with the term "mixture thereof" being defined to encompass at least one or more mixtures/combinations of boehmite and pseudo-boehmite in variable proportions without limitation). The terms "boehmite" and "pseudo-boehmite" shall be defined in a conventional fashion as would normally be understood by individuals skilled in the art to which this invention pertains. For example, boehmite traditionally involves a crystalline compound having the empirical formula AlO(OH) (including all physical forms in which boehmite exists or may otherwise be produced). In addition, "pseudo-boehmite" traditionally encompasses a type of boehmite having a higher water content than "regular" crystalline boehmite of the variety mentioned above (with pseudo-boehmite also being known as "gelatinous boehmite"). While the claimed invention shall not be restricted to any particular quantity values in connection with the pigment (optimally boehmite, pseudo-boehmite, or a mixture thereof as the sole pigment material), an exemplary and preferred pigment quantity will involve at least about 65% by weight (e.g. 65% by weight or more) of the completed ink-receiving layer with a preferred range being about 65–90% by weight [optimum=about 65–75% by weight]. Likewise, the numerical quantity parameters recited above shall represent the total (e.g. collective) amount of pigment(s) being used whether a single composition is employed or multiple pigments are used in combination. In other words, if a plurality of pigments are going to be employed in combination, it is preferred that the plurality (considered as a whole) fall within the above-listed numerical parameters (e.g. at least about 65% by weight, etc.) It should also be understood that the foregoing rule of construction regarding numerical quantity values should be considered applicable to all of the ingredient amounts set forth below unless otherwise noted herein. Furthermore, unless expressly stated otherwise, all percentage figures describing the material content of the various layers discussed in the claims, Summary of the Invention, and Detailed Description of Preferred Embodiments sections shall involve "dry weight", namely, the weight of the chosen component(s) in the dried material layer of interest.

Next, a plurality of binders (e.g. a "binder blend", "binder mixture", or "binder combination" which shall all be considered equivalent phrases) are provided which have been specially selected to offer a maximum degree of product stability, image water-fastness, and the like with each individual binder contributing to one or more particular benefits as outlined further below. Accordingly, the specific selection of the following preferred binder materials in combination out of all of the possible binder compounds which could have been considered for print media use represents a novel, unique, and important development. The novel combination of binders which is preferred for use in the ink receiving layer generally involves the following materials: (which will be discussed in much greater detail below including the formulae associated therewith, commercial sources, functional attributes, and the like): (1) a "first binder composition" which is comprised of polyvinyl alcohol; (2) a "second binder composition", with the second binder composition being comprised of a poly(vinyl acetate-ethylene) copolymer; and (3) a "third binder composition", with the third binder composition being comprised of a poly(vinyl pyrrolidone-vinyl acetate) copolymer. In general, the term "copolymer" basically and traditionally relates to a polymer which contains two or more different monomers. In a preferred, representative, and non-limiting embodiment, the ink-receiving layer of the present invention will contain about 5–20% by weight total binder therein [optimum=about 10–15% by weight]. These ranges will again involve the total (e.g. collective) amount of binder(s) being used whether a single binder composition is employed or multiple binders are used in combination which is preferred as stated above. In particular, if a plurality of binders is going to be employed, it is preferred that the plurality (considered as a whole) fall within the above-listed numerical range.

Regarding the individual binders recited above in the exemplary binder blend of the present invention, the following representative and preferred numerical quantities are applicable with respect to the amounts employed within the completed ink-receiving layer: (A) the first binder composition as defined above [e.g. polyvinyl alcohol]=about 1–15% by weight [optimum=about 2.5–7% by weight]; (B) the second binder composition as previously defined [e.g. a poly(vinyl acetate-ethylene) copolymer]=about 1–15% by weight [optimum=about 5–10% by weight]; and (C) the third binder composition as previously stated [e.g. a poly (vinyl pyrrolidone-vinyl acetate) copolymer]=about 0.5–10% by weight [optimum=about 0.5–3% by weight]. It should be noted that, while the above-listed values (and all other numerical parameters set forth herein) represent preferred and novel embodiments, they are subject to change as needed and desired in accordance with routine preliminary pilot testing.

Next, the ink-receiving layer of interest preferably includes therein at least one ink fixative, with the term "ink fixative" being generally defined herein to involve a material which chemically, physically, or electrostatically binds with or otherwise fixes the ink materials of interest to, within, or on the ink-receiving layer. This material is used in order to further foster a high degree of water-fastness, smear-fastness, and overall image stability. To accomplish this goal in the past, cationic polymeric dye fixatives had been considered for the above-listed purpose. However, the use of these materials presented a considerable challenge in that, when combined with colloidal pigments such as boehmite and/or pseudo-boehmite (which are of primary interest in this case as the pigments of choice), undesired gellation and/or viscosity increases (also known as "viscosification") of the pigments occurred. This situation substantially hindered the overall production process and made it difficult to fabricate a smooth, uniform, and functionally-effective ink-receiving layer having the desired characteristics set forth above. Likewise, these problems had the potential to create considerable manufacturing inefficiencies which prevented the ink-receiving layers from being produced in a rapid and economical fashion.

To avoid the difficulties listed above, two basic approaches were considered, with each having particular disadvantages. The first approach involved employment of the cationic polymeric dye fixative in a separate and distinct layer apart from the layer containing the pigment materials (with particular reference to boehmite, pseudo-boehmite, or a mixture thereof). This approach increased the overall complexity of the media product and required the use of an additional material layer which resulted in higher manufacturing costs. In addition, the multi-layer approach discussed above increased the overall quality control requirements associated with the product since an additional layer (and fabrication procedure associated therewith) was necessary. A second approach was reviewed in which the overall solids-content of the material mixture used to produce the ink-receiving layer was maintained at a low level during production (e.g. less than about 20% by weight total solids). The term "solids-content" as used herein shall be construed to involve the total amount of solid material in the mixture or composition of interest relative to the liquid components thereof (whether aqueous or non-aqueous). By maintaining a low solids-content (with minimal quantities of pigment), cationic polymeric dye fixatives could be used while at least partially avoiding pigment gellation and viscosification problems.

However, in fabricating ink-receiving layers of the type described herein, it is often desirable to produce layer structures which contain large amounts of solids (namely, substantial quantities of pigment with particular reference to boehmite, pseudo-boehmite, or a mixture thereof). Ink-receiving layers with considerable quantities of pigment therein (especially boehmite and/or pseudo-boehmite) are highly porous. This situation typically results in improved ink-absorbing capacity, greater water-fastness, and better overall image permanence. However, the production of ink-receiving layers having these characteristics (namely, a high pigment content) has been hindered by the chemical characteristics of the ink fixatives discussed above which dictate that a low solids-content coating mixture be produced (in order to avoid pigment gellation and/or viscosification). Thus, prior to the current invention, the desire for an ink-receiving layer containing large amounts of pigment could not be effectively reconciled with the use of a cationic polymeric ink fixative (which, itself, was desirable in accordance with its effective image-stabilizing characteristics).

In accordance with the current invention, a unique development has been made wherein an ink-receiving layer is provided which can include (1) a cationic polymeric ink fixative; and (2) large quantities of pigment (e.g. boehmite, pseudo-boehmite, or a mixture thereof) together within the layer. Specifically, the present invention will employ at least one special ink fixative (which is combined with the pigment) that effectively accomplishes this goal. This ink fixative constitutes at least one cationic emulsion polymer which is especially compatible with the pigment (preferably boehmite, pseudo-boehmite, or a mixture thereof). As a result of this compatibility, inducement (by the ink fixative) of gellation and increases in viscosity of the pigment during fabrication of the ink-receiving layer and thereafter is substantially avoided. Furthermore, in accordance with the foregoing development, the ink-receiving layer may be comprised of at least about 65% by weight boehmite, pseudo-boehmite, mixtures thereof, or other chosen pigment (s). Additional information concerning this particular ink fixative, the chemical class to which it belongs, and the like will be presented below in the Detailed Description of Preferred Embodiments section. However, the term "cationic emulsion polymer" shall be generally defined herein for the purposes of this invention to involve a polymer produced through an emulsion polymerization process that contains at least one monomer that is cationic in nature (e.g. positively-charged) such as a protonated amine (e.g. a primary, secondary, or tertiary amine) or a quaternized (e.g. quaternary) amine. Representative quaternary amine cationic monomers include but are not limited to trimethylammonium ethyl acrylate chloride, trimethylammonium ethyl acrylate methyl sulfate, benzyldimethylammonium ethyl acrylate chloride, benzyldimethylammonium ethyl acrylate methyl sulfate, benzyldimethylammonium ethyl methacrylate chloride, and benzyldimethylammonium ethyl methacrylate methyl sulfate. A cationic emulsion polymer of particular interest which is especially effective in offering the above-mentioned benefits comprises a quaternary amine cationic emulsion polymer as noted above (also designated herein in abbreviated form as a "quaternary amine emulsion polymer"). In general, quaternary amine compounds basically involve compounds that contain four alkyl and/or aryl groups (all the same, different, or mixtures thereof without limitation) that are bound to a central nitrogen atom. The term "quaternary amine emulsion polymer" shall be construed to encompass cationic emulsion polymers as previously defined which contain at least one quaternary amine compound or group.

In a preferred embodiment, the ink-receiving layer will comprise about 1–30% by weight [optimum=about 10–20% by weight] of the chosen ink fixative, namely, the cationic emulsion polymer(s) with particular reference to the use of a quaternary amine emulsion polymer. As previously noted, this value will involve the total (e.g. collective) amount of ink fixative/cationic emulsion polymer(s) being used whether a single compound is employed or multiple compositions are used in combination. It shall be understood that the claimed invention is not limited to any single cationic emulsion polymer, with a variety of cationic emulsion polymers (alone or combined) being suitable for use provided that they have the functional capabilities recited above. These capabilities again include a high degree of compatibility with the pigment (especially boehmite, pseudo-boehmite, or a mixture thereof). This compatibility primarily involves the ability of the chosen polymer to substantially avoid gellation and/or viscosification reactions with the pigment at the high quantity levels recited above (about 65% by weight or more in a preferred and non-limiting embodiment). An exemplary and preferred quaternary amine emulsion polymer which may be employed as the cationic emulsion polymer ink fixative in the claimed ink-receiving layer involves a proprietary composition that is commercially available from the Rohm and Haas Company of Philadelphia, Pa. (USA) under the product designation/trademark "Primal® PR-26". This material is especially effective and useful in providing the above-listed benefits (namely, the avoidance of gellation and/or viscosification problems when large amounts of pigment materials such as boehmite, pseudo-boehmite, or mixtures thereof are employed). The benefits offered by the foregoing composition result at least partially from the fact that it has a high glass transition temperature (Tg) [e.g. the temperature at which a liquid changes to a glass-like solid composition] and/or a high crosslinking capability.

It should also be noted that, expressed in a different manner, the present invention shall likewise be construed to cover a specialized fluidic (e.g. "fluid-containing") coating formulation that is used to produce a novel ink-receiving layer. This coating formulation will include, at the very least, at least one liquid carrier medium (e.g. water, organic solvents, or mixtures thereof with water as the sole carrier medium being preferred), at least one binder, and at least one pigment composition (preferably boehmite, pseudo-boehmite, or a mixture thereof as the sole pigment material in the formulation). The coating formulation will have a solids-content (as previously defined) of at least about 20% by weight or more, with a preferred range being about 20–45% by weight [optimum=about 25–40% by weight]. These % by weight values will involve the total amount of solids in the entire fluid-containing coating formulation (e.g. wet weight). Furthermore, the coating formulation will include the cationic emulsion polymer recited above, namely, a particular cationic emulsion polymer which is compatible with the pigment (e.g. boehmite, pseudo-boehmite, or a mixture thereof) and substantially avoids the inducement of gellation and increases in viscosity with respect to the pigment. As previously noted, at least one quaternary amine emulsion polymer is preferred for this purpose. Using this approach, the desired solids-content of at least about 20% by weight may be achieved in the coating formulation.

While a specific cationic emulsion polymer has been recited above in accordance with a preferred embodiment of the invention, it shall be understood that other cationic emulsion polymers are prospectively applicable to this invention provided that they are capable of performing in the manner summarized above. Specifically, such materials will have the common ability to be chemically compatible with the chosen pigment (especially boehmite, pseudo-boehmite, or a mixture thereof) in that they will substantially avoid gellation and/or viscosification problems as discussed herein. This aspect of the current invention therefore represents an important development in the print media field. Specifically, it enables a specialized print media product to be fabricated which employs a highly effective cationic emulsion polymer ink fixative while simultaneously permitting the use of large pigment quantities without gellation and/or viscosification problems. As a result, an ink-receiving layer may be fabricated which includes, for instance, at least about 65% by weight boehmite, pseudo-boehmite, or a mixture thereof, with such materials being highly porous, ink-absorbent, and capable of producing stable and water-fast printed images. Again, further information concerning the ink fixative will be provided below in the Detailed Description of Preferred Embodiments section.

The key ingredients mentioned above (e.g. at least one pigment [optimally boehmite, pseudo-boehmite, or a mixture thereof], the listed binder materials, and the cationic emulsion polymer ink fixative) cooperate to produce an ink-receiving layer and print media product which are highly distinctive from a functional and structural perspective. However, it should also be noted that other materials can optionally be used in combination with the compositions recited above. These other materials (characterized herein as "supplemental ingredients", "supplemental components", "additional materials", "added ingredients", and the like) can include the following items: (A) lactic acid; (B) at least one defoamer composition (namely, a surfactant); (D) at least one slip agent; (E) at least one biocide; (F) at least one preservative (e.g. antioxidant); (G) at least one UV/light stabilizer, (H) at least one buffer; and (I) mixtures thereof (as well as other compositions) in various proportions without limitation. The incorporation of these materials (which shall again be considered "optional") will depend on numerous factors ranging from the manner in which the print media products of interest will be used to the chemical content of the inks that are chosen for use in forming the printed images. Accordingly, the claimed invention shall not be restricted to any particular types or amounts of supplemental ingredients which may again be determined in accordance with routine preliminary testing. More detailed data will be presented below regarding supplemental ingredients of particular interest including specific examples thereof, the benefits they provide, and commercial sources where they can be obtained.

If a substrate is employed which is coated (e.g. polyethylene-coated paper or paper coated with one or more layers each comprising at least one pigment composition and at least one binder therein [as well as other materials if desired]), the ink-receiving layer of this invention is optimally (but not necessarily) placed on the side or sides that are covered with the chosen coating formulation.

Regarding the pigment-content of the ink-receiving layer, it is preferred that boehmite, pseudo-boehmite, or a mixture thereof be employed as a sole or predominant pigment which is especially novel, unique, and effective when combined with the other claimed ingredients. However, unless otherwise expressly stated herein, the present invention shall not be restricted to the use of any particular pigment materials or mixtures thereof (as well as any quantities of these ingredients). Exemplary and preferred (e.g. non-limiting) alternative pigments suitable for use in the ink-receiving layer (instead of boehmite, pseudo-boehmite, or mixtures thereof or in addition to such materials [preferred]) will involve the following compositions without limitation: silica (in precipitated, colloidal, gel, sol, or fumed form), cationic-modified silica (e.g. alumina-treated silica in an exemplary and non-limiting embodiment), cationic polymeric binder-treated silica, magnesium oxide, magnesium carbonate, calcium carbonate, barium sulfate, clay, titanium dioxide, gypsum, plastic-type pigments, mixtures thereof, and others without restriction. However, it should again be emphasized that boehmite, pseudo-boehmite, or a mixture thereof is preferred as the sole or predominant pigment material in the print media products of concern, with the use of such material being especially effective and novel when combined with the other compounds recited above (namely, the unique binder blend and/or cation emulsion polymer ink fixative listed herein). If alternative pigments such as those recited above are employed in combination with the boehmite, pseudo-boehmite, or mixtures thereof, such alternative pigments shall be characterized herein for convenience purposes as "supplemental pigment compositions".

The claimed print media products and ink-receiving layers shall not be restricted to any particular alternative/supplemental pigment compositions or amounts thereof if it is desired that such materials be employed (which shall again be considered "optional" in nature). In this regard, for example, the ink-receiving layer will contain therein the following representative and non-limiting quantity of supplemental pigment composition(s) combined with the boehmite, pseudo-boehmite, or a mixture thereof: about 0–30% by weight of the ink-receiving layer [optimum= about 5–20% by weight if the use of such supplemental pigment composition(s) is desired]. As previously noted, these values will involve the total (e.g. collective) amount of supplemental pigment composition(s) being used whether a single supplemental pigment composition is employed or multiple supplemental pigment compositions are used in combination. Further information and more specific data pertaining to representative alternative/supplemental pigment compositions (and combinations thereof) will be provided in the Detailed Description of Preferred Embodiments section.

With continued reference to the non-limiting embodiment that is currently being discussed, it is preferred that the claimed invention employ the special binder blend discussed above, namely, a first binder composition comprised of polyvinyl alcohol, a second binder composition comprised of a poly(vinyl acetate-ethylene) copolymer, and a third binder composition comprised of a poly(vinyl pyrrolidone-vinyl acetate) copolymer. This blend is particularly novel, unique, and effective. However, it shall also be understood that at least one alternative binder may be used instead of or in combination with the claimed polymer blend (preferred). The decision to use any alternative binder compositions shall be undertaken in accordance with routine preliminary pilot testing taking into account a number of factors including the other ingredients employed within the ink-receiving layer, the inks to be used with the layer, and the like.

Exemplary and preferred (e.g. non-limiting) alternative binder compositions suitable for use in the ink-receiving layer (instead of the claimed binder blend or in addition thereto [preferred]) will involve the following compositions without limitation: starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl alcohol-ethylene oxide) copolymer, and others without restriction. If alternative binders including but not limited to those recited above are employed in combination with the foregoing binder blend (namely, the first, second, and third binder compositions), such alternative binders shall be characterized herein as "supplemental binder compositions". However, the claimed print media products and ink-receiving layers shall not be restricted to any particular alternative/supplemental binder compositions if it is desired that such materials be employed (which shall again be considered "optional" in nature).

With continued reference to the use of one or more supplemental binder compositions in combination the foregoing binder blend, the ink-receiving layer will contain, for example, the following representative and non-limiting quantity of supplemental binder composition(s): about 0–10% by weight of the ink-receiving layer [optimum= about 0.5–3% by weight if the use of such supplemental binder composition(s) is desired]. As previously noted, these values will involve the total (e.g. collective) amount of supplemental binder composition(s) being used whether a single supplemental binder composition is employed or multiple supplemental binder compositions are used in combination. Further information pertaining to representative alternative/supplemental binder compositions (and combinations) thereof will be provided in the Detailed Description of Preferred Embodiments section. Likewise, regarding the ink-receiving layer, it may include one or more alternative/supplemental binder compositions, one or more alternative/supplemental pigment compositions, or both of such materials in combination with the other ingredients recited above (namely, boehmite and/or pseudo-boehmite, the claimed binder blend, and the cationic emulsion polymer ink fixative) if desired and appropriate. It is therefore important to recognize that many different combinations of ingredients are possible, with the present invention being defined by the claims presented herewith. Such claims shall be construed to the broadest extent possible taking all appropriate equivalents into account.

In an exemplary and preferred embodiment designed to provide optimum results, the following representative formulation may be used in connection with the completed ink-receiving layer of the present invention:

(A) pigment [boehmite, pseudo-boehmite, or a mixture thereof]–about 65–90% by weight [optimum=about 65–75% by weight];

(B) first binder composition [polyvinyl alcohol]–about 1–15% by weight [optimum=about 2.5–7% by weight];

(C) second binder composition [a poly(vinyl acetate-ethylene) copolymer]–about 1–15% by weight [optimum=about 5–10% by weight];

(D) third binder composition [a poly(vinyl pyrrolidone-vinyl acetate) copolymer]–about 0.5–10% by weight [optimum=about 0.5–3% by weight];

(E) an ink fixative [a cationic emulsion polymer with particular reference to the specific composition recited above, namely, a quaternary amine emulsion polymer]–about 1–30% by weight [optimum=about 10–20% by weight];

(F) at least one defoamer composition–about 0.02–2% by weight [optimum=about 0.1–1% by weight];

(G) lactic acid–about 0.5–4% by weight [optimum=about 1–2% by weight]; and (H) at least one slip agent–about 0.25–5% by weight [optimum=about 0.5–2% by weight].

Regarding the above-listed formulation, it is again being provided for example purposes only and shall not limit the invention in any respect. Furthermore, the numerical parameters recited above in connection with the foregoing example shall, as previously stated, represent the total (e.g. collective) amount of the ingredient under consideration whether a single ingredient is employed or multiple ingredients are used in combination. For example, if a plurality of surfactants are going to be incorporated within the ink-receiving layer, it is preferred that the plurality (considered as a whole) fall within the above-listed numerical range. The foregoing values may be varied as needed and desired in accordance with routine preliminary pilot testing and shall be construed to involve the % by dry weight of the completed ink-receiving layer unless otherwise noted.

Furthermore, the claimed ink-receiving layer may be used in combination with one or more other layers of material located thereover or thereunder without limitation regarding the number of such layers, the location of these structures, or the content thereof. While the present discussion shall focus on the use of one ink-receiving layer containing the desired ingredients as outlined herein, it is contemplated that more than one of these layers can be employed without limitation. Such layers (or layer if only one is used which is preferred) can again be located anywhere on or within the print media products as long as they can, in some fashion, receive all or part of the ink materials being delivered by the printer unit. All of these variations are again applicable to each of the embodiments discussed herein as well as those which are covered by the claims set forth below.

In a still further alternative embodiment which was partially discussed in the preceding paragraph, the print media product can be provided with at least one additional (e.g. "optional") material layer in addition to the specialized ink-receiving layer(s) mentioned above. This additional material layer can, in a preferred and non-limiting embodiment, be positioned or otherwise formed between the substrate (whether coated or uncoated) and the ink-receiving layer(s) in the claimed print media products if needed and desired. Alternatively, the additional material layer can be positioned or otherwise formed over and above the ink-receiving layer(s). The use of this additional material layer is applicable to all of the embodiments discussed above and all others encompassed within the claimed subject matter. The content of this additional material layer can vary without limitation regarding the types and amounts of compositions which can be used therein. For example, the additional material layer can be comprised of at least one binder, at least one pigment composition, or mixtures thereof without limitation. The current alternative embodiment will therefore encompass a situation where the additional material layer(s) discussed herein may involve a wide variety of compositions without limitation as to content and proportion including all of those materials recited above in connection with the claimed ink-receiving layer. Such compositions may include boehmite, pseudo-boehmite, or mixtures thereof, the listed polymer blend, the claimed cationic emulsion polymer ink fixative, the alternative/supplemental binders, the alternative/supplemental pigments, as well as one or more defoamer compositions, lactic acid, slip agents, combinations of the above-listed items, and other materials with restriction. Again, one or more of the additional material layers can be used in this embodiment, with such layers also being appropriately characterized as "medial" or "intermediate" layers if they are to be located between the substrate (coated or uncoated) and the aforementioned ink-receiving layer(s) which is preferred. In such an embodiment, the additional material layer (if only one is used) will be secured by "direct attachment" (preferred but not required) to the substrate, with the ink-receiving layer (if only one is used) being secured by "direct attachment" (preferred but not required) to the additional material layer. However, it should generally be stated that the additional material layer is "operatively attached" to both the substrate and the claimed ink-receiving layer(s), with this term being defined above.

As a further point of general information, the material layers associated with all of the embodiments discussed herein may be placed over and above (as defined herein) only one side of the coated or uncoated substrate or on both sides thereof (preferred). If a coated substrate is employed, it is again desirable to place the ink-receiving layers of interest on the coated side(s) as previously stated. However, an optimum embodiment will involve a situation where a substrate is chosen which is coated on both sides as mentioned above. The ink-receiving layer(s) of interest are then placed over and above (e.g. operatively attached to and supported by) both sides of the coated substrate.

A number of different manufacturing techniques may be implemented in connection with the various embodiments of this invention without restriction as outlined further in the Detailed Description of Preferred Embodiments section. From a general standpoint, the claimed methods of interest will encompass the following basic steps (with the previously-described information involving construction materials, size parameters, chemical compositions, and the like in connection with the ink-receiving layer being incorporated by reference in the current discussion): (1) providing a substrate; and (2) forming at least one ink-receiving layer in position over and above the substrate with the ink-receiving layer comprising the formulations and materials discussed above (which will not be repeated in full for the sake of bevity but are again incorporated in the present discussion by reference). As previously noted, the ink-receiving layer can incorporate a number of different ingredient combinations without limitation in connection with step (2) listed above. These ingredients may include, for instance, at least one pigment (optimally boehmite, pseudo-boehmite, or a mixture thereof) combined with a polymer blend comprised of a first binder composition (e.g. polyvinyl alcohol), a second binder composition (e.g. a poly(vinyl acetate-ethylene) copolymer), and a third binder composition (e.g. a poly(vinyl pyrrolidone-vinyl acetate) copolymer). Likewise, if needed and desired, at least one supplemental binder composition can be used in combination with the other binders recited above.

Furthermore, the formulation associated with the ink receiving layer can involve a pigment composition (optimally a material selected from the group consisting of boehmite, pseudo-boehmite, and a mixture thereof, with this material being present an amount equal to at least about 65% by weight of the ink-receiving layer) combined with at least one ink fixative. As previously stated, the ink fixative optimally comprises a cationic emulsion polymer (with particular reference to the use of a quaternary amine emulsion polymer) which is especially compatible with the pigment (boehmite, pseudo-boehmite, or a mixture thereof) in that it will substantially avoid the gellation and/or viscosification of such material. Also combinable with the ink fixative and pigment composition is the binder system summarized above. Again, all of the different variants of the ink-receiving layer discussed herein are applicable to the claimed methods without limitation and are incorporated by reference in connection with these methods. Likewise, the term "forming" as used in the claimed methods shall generally signify the creation and placement as a whole of the completed (e.g. dried) ink-receiving layer on the substrate as discussed further below.

Finally, all of the above-listed methods may involve the further optional step of providing the print media product with at least one additional material layer in addition to the specialized ink-receiving layer(s) discussed herein. This step will preferably comprise placing (e.g. forming as defined above) the additional material layer in position over and above the substrate prior to forming the ink-receiving layer thereon. As a result of this process, the additional material layer will be located between the substrate and the ink-receiving layer. Alternatively, the additional material layer may be placed (e.g. formed) in position over and above the ink-receiving layer(s) of interest. All of the information, data, construction materials, and parameters associated with the additional material layer as previously discussed are incorporated by reference in connection with the method step summarized in this paragraph.

The completed print media products described herein are designed to receive and retain a printed image thereon in a highly effective manner. The novel features discussed above individually and collectively constitute a significant advance in the art of image generation and print media technology. In particular, the unique structures, components, and methods of the invention offer many important benefits compared with prior systems and products including but not limited to: (1) a high level of light-fastness; (2) rapid drying times in order to avoid smudging and image deterioration immediately after printing is completed due to contact with physical objects and the like; (3) the fast and complete absorption of ink materials in a manner which avoids image distortion caused by color bleed; (4) a highly water-fast character; (5) the generation of "crisp" images with a distinct and defined character; (6) the ability to produce printed products which are substantially "smear-fast"; (7) the control of "ink-coalescence" as previously defined; (8) the capacity to generate printed images with desired levels of gloss or semi-gloss wherein the final product is characterized by uniform gloss levels throughout the entire image in order to achieve a professional and aesthetically-pleasing printed media sheet; (9) the ability to attain a high level of consistency during large-scale production regarding the overall surface characteristics of the completed media products; (10) low material costs which enable the print media products of interest to be employed for mass market home and business use; (11) chemical compatibility with a wide variety of ink formulations which leads to greater overall versatility; (12) excellent levels of image stability and retention over long time periods; (13) minimal complexity from a production, material-content, and layer-number standpoint (with as few required layers as possible being desirable) which leads to reduced fabrication costs and greater product reliability; and (14) a high level of gloss-control which is achievable in a rapid and effective manner during production through only minor adjustments in the manufacturing process. These and other benefits, objects, features, and advantages of the invention will become readily apparent from the following Brief Description of the Drawings and Detailed Description of Preferred Embodiments.

BRIEF DESCRIPTION OF THE DRAWINGS

The drawing figures provided herein are schematic, representative, and not necessarily drawn to scale. They shall not limit the scope of the invention in any respect. Reference numbers which are carried over from one figure to another shall constitute common subject matter in the figures under consideration. Likewise, the cross-hatching shown in the drawing figures is provided for example purposes only and shall not restrict the invention to any particular construction materials. In addition, the illustration of any given number of elements, components, layers, layering arrangements, layering sequences, and other structural features shall be considered representative only and shall not limit the invention in any respect unless otherwise expressly stated herein.

DETAILED DESCRIPTION OF THE PREFERRED EMBODIMENT

Figure 1:
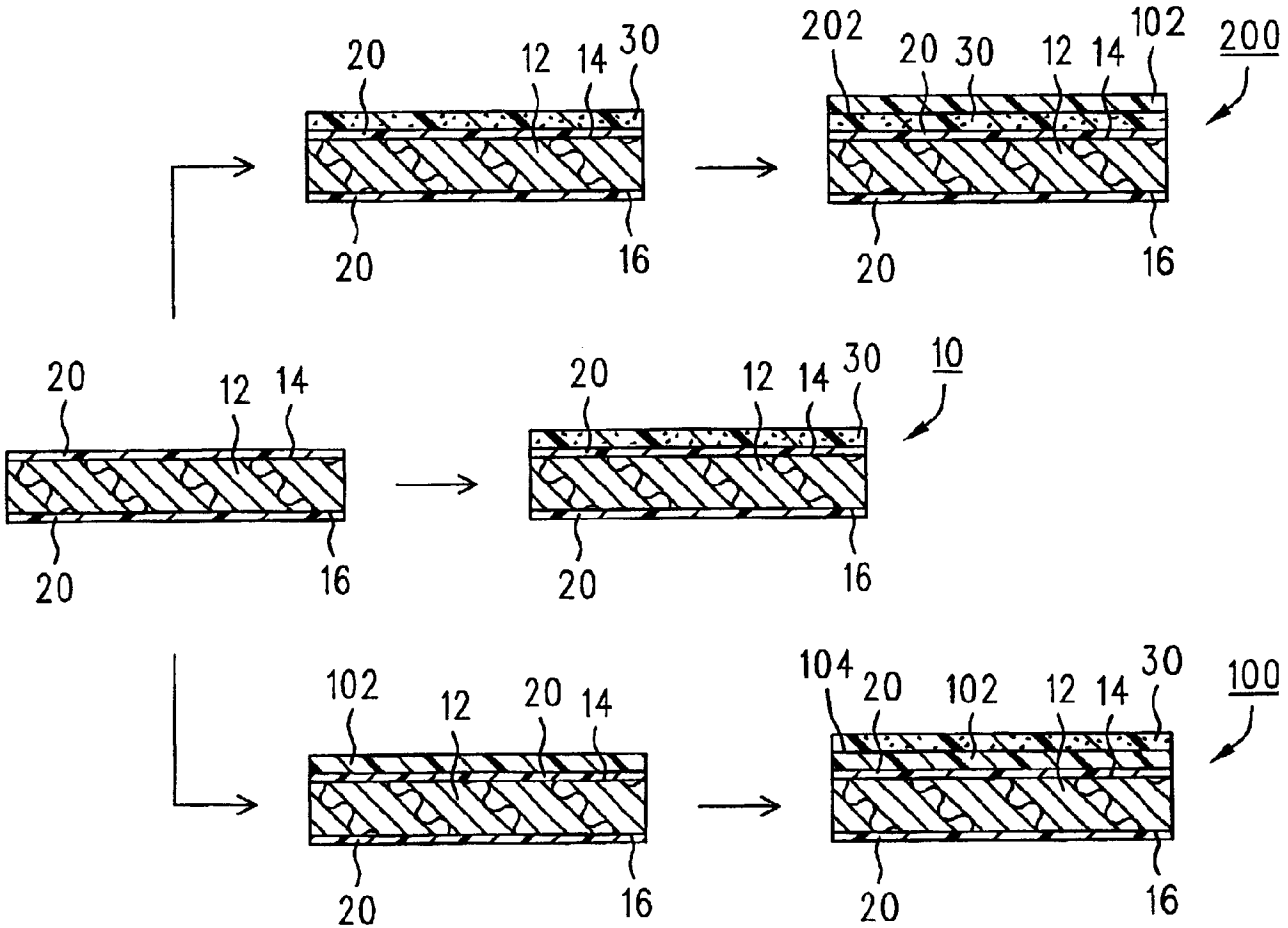
FIG. 1 is a schematically-illustrated, sequential view of the preferred process steps, materials, and techniques that are employed to produce the novel print media products of the present invention.

In accordance with the present invention, high-efficiency print media products (also characterized herein as "ink-receiving sheets") are provided which have multi-functional capabilities as noted above. In particular, the claimed media products offer multiple benefits in combination including but not limited to (A) the production of images that have a high degree of definition, clarity, and resolution; (B) rapid drying; (C) a high level of water-fastness and smear-fastness; (D) the ability to control ink-coalescence as defined above; and (E) the capacity to generate a final imaged product having a uniform level of quality and visual clarity (as well as uniform surface features including but not limited to consistent gloss levels [with a semi-gloss character being preferred]). Other benefits are likewise provided by the claimed invention as outlined above. In this regard, the various embodiments of the invention collectively constitute an important advance in the print media and image generation fields.

Likewise, as previously stated, the print media products described herein are prospectively applicable to many different ink delivery systems and ink materials containing various dyes, pigments, toners (liquid and solid), and colorants. Of primary interest are ink delivery systems that employ thermal inkjet technology. Printing units using thermal inkjet technology again basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are again discussed in, for example, U.S. Pat. No. 4,771,295 to Baker et al. and U.S. Pat. No. 5,278,584 to Keefe et al. which are both incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer conduits. These particular systems are conventionally known as "off-axis" printing units. A representative, non-limiting off-axis ink delivery system is again discussed in, for example, U.S. Pat. No. 5,975,686 to Hauck et al. which is also incorporated herein by reference. The present invention as described below is applicable to both on-board and off-axis systems (as well as any other types which include at least one ink containment vessel that is either directly or remotely in fluid communication with a printhead containing at least one ink-ejecting resistor therein). Furthermore, while the print media products outlined in this section will be discussed with primary reference to thermal inkjet technology, it shall be understood that they may be employed in connection with different ink delivery systems and methods including but not limited to piezoelectric drop devices of the variety disclosed in U.S. Pat. No. 4,329,698 to Smith and dot matrix units of the type described in U.S. Pat. No. 4,749,291 to Kobayashi et al., as well as other comparable and diverse systems designed to deliver ink using one or more ink delivery components/assemblies. In this regard, the claimed print media products and methods shall not be considered "print method-specific". As an additional point of information, exemplary printer units which are suitable for use with the print media products of the present invention include but are not limited to those manufactured and sold by the Hewlett-Packard Company of Palo Alto, Calif. (USA) under the following product designations: "DESKJET®" 400C, 500C, 540C, 660C, 693C, 820C, 850C, 870C, 895CSE, 970CSE, 990CXI, 1200C, and 1600C, as well as systems sold by the Hewlett-Packard Company under the "DESIGNJET®" trademark (5000 series), and others.

Furthermore, the claimed invention (namely, the novel print media products and production methods associated therewith) are not "ink-specific" and may be used in connection with a wide variety of inks, dyes, pigments, liquid and solid toner compositions, sublimation dyes, colorants, stains, and the like without restriction. For example, representative ink compositions that can be employed in connection with the print media materials of this invention include but are not limited to those discussed in U.S. Pat. Nos. 4,963,189 and 5,185,034 (both incorporated herein by reference) which represent only a small fraction of the ink compositions and colorant formulations that can be used with the present invention.

At this point, a detailed discussion of the claimed print media products will now be presented with the understanding that the data set forth below shall be considered representative in nature, with the current invention being defined by the claims presented herein. It shall also be understood that the recitation of specific materials and embodiments that are identified as "preferred" constitute novel developments that provide optimum and unexpectedly effective results. Furthermore, all of the definitions, terminology, and other information recited above in the Summary of the Invention section are applicable to and incorporated by reference in the current Detailed Description of Preferred Embodiments section.

Figure 2:
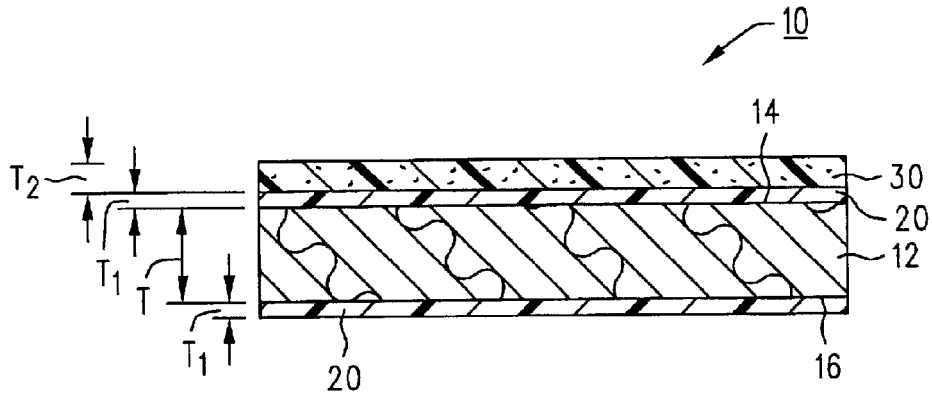
FIG. 2 is a schematically-illustrated and enlarged partial cross-sectional view of a completed print media product produced in accordance with a novel and preferred embodiment of the invention illustrating the material layers and thicknesses associated therewith.

In accordance with FIGS. 1 and 2, a preferred print media product in completed form for use as an image-receiving sheet is schematically illustrated at reference number 10. The methods, materials, process steps, and other data associated with print media product 10 will now be discussed which constitutes a representative and non-limiting preferred embodiment designed to produce excellent results. As illustrated in FIGS. 1–2, a substrate 12 (also known as a "support structure", "support", or "base member" with all of such terms being considered equivalent from a structural and functional standpoint) is initially provided. The other layers and materials associated with the print media product 10 reside on this structure as discussed further below. The substrate 12 is optimally fabricated in the form of a flexible sheet comprising an upper surface 14 (also characterized herein as a "first side") and a lower surface 16 (also characterized herein as a "second side"), with both of the surfaces/sides 14, 16 being substantially planar and having a uniform surface texture in the representative embodiment of FIG. 2. Likewise, the substrate 12 may be configured in roll, web, strip, film, or sheet form with transparent, semi-transparent, or opaque characteristics as needed and desired.

In a preferred version of the print media product 10 (which optimally involves the use of cellulosic [e.g. cellulose-containing] paper in sheet form as the substrate 12), the substrate 12 will have an exemplary and non-limiting uniform thickness "T" (FIG. 2) along its entire length of about 0.025–0.25 mm [optimum=about 0.05–0.20 mm], with these ranges also being applicable to all of the other substrate materials discussed herein. Other construction compositions that can be employed in connection with the substrate 12 aside from paper include but are not limited to paperboard, wood, cloth, non-woven fabric, felt, synthetic (e.g. non-cellulosic) paper, ceramic compositions (optimally unglazed), glass or glass-containing compositions, metals (e.g. in foil form made from, for instance, aluminum [Al], silver [Ag], tin [Sn], copper [Cu], mixtures thereof, and others as determined by the intended use of the completed print media product 10), and composites of such materials. Likewise, various organic polymer compositions can be employed in connection with the substrate 12 including, without limitation, those fabricated from polyethylene, polystyrene, polyethylene terephthalate, polycarbonate resins, polytetrafluoroethylene (also known as "Teflon®"), polyimide, polypropylene, cellulose acetate, poly(vinyl chloride), and mixtures thereof.

However, as previously stated, commercially-available paper is preferred in connection with the substrate 12, with the present invention not being restricted to any particular type of paper. In an exemplary and non-limiting embodiment designed to offer optimum results (including a high degree of strength, flexibility, and durability), cellulosic paper materials can be employed wherein at least one of the upper and lower surfaces (e.g. first and second sides) 14, 16 thereof (preferably the upper surface 14 which faces the various layers in the print media product 10 or both surfaces 14, 16) are coated with a selected coating material that is substantially non-porous, non-absorbent, and ink-impermeable. In the representative embodiment illustrated schematically in FIG. 2, a coating layer 20 is provided on the upper and lower surfaces 14, 16 of the substrate 12 (e.g. made of paper as previously noted). The coating layer 20 optimally has a uniform thickness "$T_1$" (FIG. 2) of about 1–40 $\mu$m [optimum=about 1–20 $\mu$m], with this range being applicable to all of the coating materials set forth herein and subject to change as needed and desired. The coating layer 20 may be produced from a number of compositions without limitation, with such compositions (and the use of a coating layer 20 in general) being selected in accordance with numerous factors including the type of ink being delivered, the printing system in which the print media product 10 will be used, and the like. If a non-porous, non-ink-absorbent coating layer 20 is desired, a representative material suitable for this purpose would involve polyethylene although other compositions can be employed to achieve this goal including various organic polymers such as polystyrene, polyethylene terephthalate, polycarbonate resins, polytetrafluoroethylene (Teflon®), polyimide, polypropylene, cellulose acetate, poly (vinyl chloride), and mixtures thereof.

Alternatively, the coating layer 20 (irrespective of whether it is placed on either or both surfaces 14, 16 of the substrate 12) may involve a wide variety of other ingredients in order to form a more absorbent layer of material. These various ingredients include but are not limited to one or more pigment compositions, binders, fillers, and other "supplemental ingredients" such as defoamer compositions (e.g. surfactants), biocides, UV/light stabilizers, buffers, slip agents, preservatives (e.g. antioxidants), lactic acid, and the like. Of primary concern in connection with such a coating layer 20 is the use of at least one or more pigment compositions in combination with at least one or more binders. The present invention shall not be restricted to any particular compositions in connection with this type of coating layer 20. In this regard, many different materials, material quantities, and formulations are possible. Exemplary pigments which can be employed in connection with the coating layer 20 (should pigments be desired therein) include but are not limited to boehmite, pseudo-boehmite, silica (in precipitated, colloidal, gel, sol, and/or fumed form), cationic-modified silica (e.g. alumina-treated silica in an exemplary and non-limiting embodiment), cationic polymeric binder-treated silica, magnesium oxide, magnesium carbonate, calcium carbonate, barium sulfate, clay, titanium dioxide, gypsum, mixtures thereof, and others without limitation. Likewise, at least some of the pigment compositions listed above may also be employed within the main ink-receiving layer of the claimed invention which will be more fully explained below.

A representative and non-limiting quantity value associated with the use of one or more pigment compositions in the coating layer 20 is about 20–90% by weight [optimum= about 40–70% by weight], with these numerical parameters being subject to change as needed and desired. Likewise, the above-listed values will again involve the total (e.g. collective) amount of pigment composition(s) being used whether a single pigment composition is employed or multiple pigments are used in combination as previously stated.

Regarding the use of one or more binder materials in the coating layer 20, such compositions may include (without limitation) polyvinyl alcohol and derivatives thereof (e.g. carboxylated polyvinyl alcohol, sulfonated polyvinyl alcohol, acetoacetylated polyvinyl alcohol, and mixtures thereof), starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl pyrrolidone-vinyl acetate) copolymer, a poly(vinyl acetate-ethylene) copolymer, a poly(vinyl alcohol-ethylene oxide) copolymer, mixtures thereof, and others without restriction. In this regard, the coating layer 20 shall not be limited to any given binders with many different variants being possible. At least some of the binder compositions listed above may also be employed within the main ink-receiving layer of the claimed invention which will be more fully explained below.

A representative and non-limiting quantity value associated with the use of one or more binder materials in the coating layer 20 is about 10–80% by weight [optimum= about 10–40% by weight], with these numerical parameters being subject to change as needed and desired. The foregoing values will again involve the total (e.g. collective) amount of binder(s) being used whether a single binder composition is employed or multiple binders are used in combination as previously stated. Should any of the other components recited above (namely, the "supplemental ingredients") be employed within this particular embodiment of the coating layer 20 (with the use of such supplemental ingredients being considered "optional"), the amount thereof may vary as needed and desired. In this regard, the present invention shall not be limited to any particular numerical values in connection with the coating layer 20, with the amount of binders and/or pigments in the layer 20 (if used) being reduced proportionately relative to the quantity of any supplemental ingredients that may be added.

While the use of coating layer 20 on either or both surfaces 14, 16 of the substrate 12 can impart added strength and image clarity to the final print media product 10 (or other benefits depending on the ingredients being employed), the coating layer 20 can be eliminated entirely on either or both surfaces 14, 16 of the substrate 12 if desired as again determined by routine preliminary testing. The claimed print media products shall not be restricted to any given type of coating layer 20 or the use thereof in general.

For the purposes of this invention, if a coated substrate 12 is employed as discussed above, the coating layer 20 shall be construed and defined as part of the substrate 12, with the representative thickness value "T" associated with the substrate 12 being suitably adjusted in this regard. Such a characterization is appropriate since coated paper materials including those discussed herein are traditionally available in pre-manufactured form from various paper suppliers and producers. For example purposes, a representative paper substrate 12 covered on both surfaces/sides 14, 16 with a coating layer 20 made of polyethylene is commercially available in completed form from Felix Schoeller Technical Papers, Inc. of Pulaski, N.Y. (USA) [product designations 108395, 108396, and 108397, for example]. Likewise, an exemplary paper substrate 12 which is coated on both surfaces/sides 14, 16 with a coating layer 20 comprised of a proprietary blend of at least one pigment composition and at least one binder is commercially available from Westvaco Corporation of New York, N.Y. (USA).

With continued reference to FIGS. 1–2, an ink-receiving layer 30 is preferably applied (e.g. operatively attached) to the coating layer 20 on the upper surface 14 of the substrate 12 so that the ink-receiving layer 30 is positioned over and above the substrate 12 as illustrated. In this manner, the ink-receiving layer 30 is supported by the substrate 12, with the term "supported" being defined above. If the coating layer 20 was not employed on the substrate 12, the ink-receiving layer 30 in the embodiment of FIG. 2 would simply be placed on the upper surface 14. The ink-receiving layer 30 in the current embodiment of FIG. 2 is designed and configured for use as the "top", "uppermost", or "outermost" layer of material associated with the print media product 10 as previously defined. Likewise, in the present embodiment, the ink-receiving layer 30 is optimally (but not necessarily) configured for direct attachment to the coating layer 20/upper surface 14 of the substrate 12. As noted above, the term "direct attachment" is defined to involve affixation of the ink-receiving layer 30 to the coating layer 20/upper surface 14 of the substrate 12 without any intervening material layers therebetween in order to minimize the number of material layers employed in the final print media product 10. However, it shall be understood that one or more intervening material layers can be used between the ink-receiving layer 30 and the substrate 12 (whether coated or uncoated) if needed and desired as determined by routine preliminary research. These intervening material layers can be made from a wide variety of different compositions without restriction as outlined in greater detail below relative to the embodiment of FIG. 3.

Furthermore, it shall be understood as discussed herein that the ink-receiving layer 30 is again designated herein as being "supported" by the substrate 12 (whether coated or uncoated with the coating layer 20). This characterization is important and emphasizes the fact that the substrate 12 is employed as a structural component on which the ink-receiving layer 30 can reside (whether directly on the substrate 12 or on any layers operatively attached thereto or associated therewith including the coating layer 20 or other layers as discussed below in connection with the embodiments of FIGS. 3 and 4).

All of the embodiments described herein and shown in each of the drawing figures (FIGS. 1–4) are basically "one-sided" with the ink-receiving layer 30 and any layer(s) thereunder or thereover being located on only one side of the substrate 12 (e.g. the coating layer 20/upper surface 14). Nonetheless, other print media products encompassed within this invention may involve placement of the foregoing layers on either or both sides of the substrate 12 (coated or uncoated) if needed and desired without limitation. In this regard, the use of "on the substrate", "over and above the substrate", "operatively attached to the substrate", "supported" by the substrate, and the like when describing the layering arrangements of this invention shall encompass both "one-sided" and "dual-sided" media sheets. This language will specifically involve situations in which the subject layers are placed on either or both sides of the substrate 12. However, if a substrate 12 is employed which includes a coating layer 20 thereon as discussed herein, the ink-receiving layer 30 and any layer(s) thereunder or thereover are optimally (but not necessarily) placed on the side or sides of the substrate 12 that are coated with the layer 20 irrespective of the materials employed within the layers 20, 30.

From a functional standpoint, the ink-receiving layer 30 is designed to provide a high degree of "capacity" (e.g. ink-retention capability) in connection with the print media product 10, to facilitate rapid drying of the printed, image-containing media product 10, to generate images that are highly water-fast, and to create a print media product 10 with a smooth/even surface having a desired degree of gloss (preferably "semi-gloss"). The ink-receiving layer 30 should likewise be able to substantially prevent ink-coalescence as previously noted. Furthermore, the ink-receiving layer 30 should be able to generate water-fast and smear-fast images using a wide variety of inks, colorant materials, pigments, dye dispersions, sublimation dyes, liquid or solid toner formulations, stains, and other comparable chromatic (e.g. colored) or achromatic (black or white) compositions without limitation.

In an exemplary and non-restrictive embodiment, the ink-receiving layer 30 will have a representative and non-limiting uniform thickness "$T_2$" (FIG. 2) along its entire length of about 1–50 $\mu$m [optimum=about 20–30 $\mu$m] although this range may be varied as necessary. From a material-content standpoint, the ink-receiving layer 30 in this embodiment (with other embodiments also being possible as noted below) includes a number of very special ingredient combinations which are designed to facilitate the attainment of numerous important goals in a novel and effective manner including those recited above. These special ingredient combinations and their use in the claimed ink-receiving layer 30 will now be discussed.

First, the ink-receiving layer 30 will employ therein at least one or more pigment compositions. The term "pigment" or "pigment composition" shall generally be defined in a standard fashion to involve a material which is used to impart color, opacity, and/or structural support (e.g. in a "filler" capacity) to a given formulation. The present invention shall not be restricted to any given pigment materials (organic or inorganic in nature), pigment quantities, and number of pigments in combination. However, in order to obtain optimum results and in a preferred embodiment which is novel and unique as outlined herein, the ink-receiving layer 30 will contain therein a single pigment material with this pigment composition involving boehmite, pseudo-boehmite, or a mixture thereof (which shall be characterized herein collectively as the "main" pigments). Within the foregoing group of materials, boehmite would be considered preferred. The terms "boehmite" and "pseudo-boehmite" are defined above and preferred for use as pigments in the ink-receiving layer 30 of the present invention because of their high porosity (which aids in rapid drying of the printed image), small particle size (in order to readily achieve desired levels of gloss and gloss-control), dispersion-stability (which assists in the overall manufacturing process), and relative transparency (to improve color saturation in connection with the printed image). Regarding preferred characteristics associated with the supply of boehmite and/or pseudo-boehmite that is suitable for employment within the ink-receiving layer 30, such characteristics include but are not limited to: a particle size of about 10–400 nm (optimum=about 100–300 nm), a surface area of about 40–400 $m^2/g$ (optimum=about 40–150 $m^2/g$), a porosity of about 0.3–1 cc/g (optimum=about 0.5–0.7 cc/g), and a pore diameter of about 10–200 nm (optimum=about 50–70 nm). It should also be noted that a mixture of boehmite and pseudo-boehmite can also be used as the pigment composition (with the mixture as a whole being considered the "composition"). Further information concerning this aspect of the invention will be discussed below. Boehmite and/or pseudo-boehmite materials which can be employed for the purposes listed herein (namely, for use as the sole or predominant pigment in the ink-receiving layer 30) can be obtained from many commercial sources including but not limited to Sasol Chemical Industries, Inc. of Hong Kong, China under the product designation/trademark "Catapal® 200". This proprietary material generally has the chemical and physical characteristics listed above and consists primarily of boehmite possibly containing minor amounts of pseudo-boehmite combined therewith.

As noted herein, it is preferred that boehmite, pseudo-boehmite, or a mixture thereof be used as the sole pigment in the ink-receiving layer 30. However, one or more other pigment materials can be employed in combination with or instead of the foregoing materials although it is again best if at least some boehmite and/or pseudo-boehmite is present. It is desired that boehmite, pseudo-boehmite, or a mixture thereof be the sole or majority pigment since it provides the special benefits listed above and is particularly novel in combination with the other ingredients specified herein. Regarding alternative pigment compositions which can be employed in the ink-receiving layer 30 (aside from or in combination with boehmite, pseudo-boehmite, or a mixture thereof [preferred]), such materials include but are not limited to silica (in precipitated, colloidal, gel, sol, and/or fumed form), cationic-modified silica (e.g. alumina-treated silica in an exemplary and non-limiting embodiment), cationic polymeric binder-treated silica, magnesium oxide, magnesium carbonate, calcium carbonate, barium sulfate, clay, titanium dioxide, gypsum, mixtures thereof, and others. Silica gel is of particular interest within this group as an alternative pigment, with such composition typically being fabricated by combining mineral acid materials with silicates (sodium silicate and the like). The resulting product consists of an aggregated network-type structure within a liquid medium. While the present invention (with particular reference to the ink-receiving layer 30) shall not be restricted to any types or grades of silica, a representative silica gel composition suitable for use therein (if desired) will have an exemplary/preferred mean silica particle size (e.g. diameter) of about 0.3–0.4 $\mu$m in water and an exemplary/preferred mean porosity of about 0.8–0.9 cc/g which provides excellent results. This particular silica material is commercially available from, for example, Grace Davison, Inc. of Columbia, Md. (USA) under the product designation "GD009B". However, the recitation of silica as an alternative pigment composition to be employed in this particular embodiment is again being provided for example purposes only. As repeatedly discussed herein, boehmite, pseudo-boehmite, or a mixture thereof is the material of choice in the current formulation as either the sole or predominant pigment composition, with the other materials recited above being more appropriately characterized as subsidiary to the use of boehmite and/or pseudo-boehmite. Furthermore, if alternative pigments such as those recited above are employed in combination with boehmite, pseudo-boehmite or a mixture thereof, such alternative pigments shall be characterized herein for convenience purposes as "supplemental pigment compositions" or "supplemental pigments".

Regarding the quantity values associated with the pigment-content of the ink-receiving layer 30, the present invention shall not be limited to any given amounts. However, it is desired that the ink-receiving layer 30 have a high-solids content (discussed further below) with a considerable amount of pigment therein. This situation is preferred in connection with the ink-receiving layer 30 in order to provide a more porous structure which is characterized by improved ink-absorbing capacity, greater water-fastness, better image clarity, and superior overall stability compared with conventional products containing lesser amounts of pigment. Although variable amounts of pigment may be employed, it is preferred (in order to achieve optimum results) that the pigment quantity be not less than about 65% by weight (e.g. at least about 65% by weight or more) of the ink-receiving layer 30. This high quantity is desired (with particular reference to the use of boehmite, pseudo-boehmite, or a mixture/mixtures of boehmite and pseudo-boehmite as the sole pigment composition) for the general reasons given above.

As previously stated, all of the material-quantity values expressed herein as a percentage (unless otherwise indicated) involve "dry weight". An exemplary and preferred ink receiving layer 30 will contain about 65–90% by weight pigment composition [optimum=about 65–75% by weight]. These preferred and non-limiting values shall be considered applicable to the use of boehmite, pseudo-boehmite, or a mixture thereof as the sole pigment composition, these materials in combination with one or more alternative (e.g. supplemental) pigment compositions, and one or more alternative pigment compositions without any boehmite and/or pseudo-boehmite. It should again be noted that the numerical parameters recited above shall represent the total (e.g. collective) amount of pigment(s) being used whether a single composition is employed or multiple pigments are used in combination. In other words, if a plurality of pigments are chosen for incorporation within the ink-receiving layer 30, it is preferred that the plurality (considered as a whole) fall within the above-listed numerical parameters. This guideline is also applicable to a mixture of boehmite and pseudo-boehmite, with the total quantity of the mixture as a whole optimally falling within this above listed ranges, with the layer 30 comprising, for example, about 65–90% by weight of the chosen mixture [optimally about 65–76% by weight]. Regarding the use of a mixture of boehmite and pseudo-boehmite as the pigment composition/material, the present invention shall not be restricted to any numerical values involving the relative amounts of boehmite and pseudo-boehmite therein, with any values being suitable for use. However, in an exemplary and non-limiting embodiment, such a mixture will contain about 60–99% by weight boehmite [optimum=about 90–99% by weight] with the balance being pseudo-boehmite. Furthermore, more or less than the pigment amounts listed above can be used if needed and desired in accordance with routine preliminary pilot testing.

In a representative embodiment designed to provide best results, the ink-receiving layer 30 will again include therein at least about 65% by weight boehmite, pseudo-boehmite, or a mixture thereof as the sole pigment composition. The ability to employ such a substantial amount of pigment (especially boehmite and/or pseudo-boehmite) in combination with, for instance, cationic polymeric ink fixatives is a unique aspect of the current invention. Specifically, as discussed extensively below, combining large amounts of pigment (particularly boehmite and/or pseudo-boehmite) with cationic polymer-type ink fixatives (which are especially effective) can create an undesired reaction between the two. This reaction typically causes gellation and/or viscosification of the pigment, namely, a thickening of the pigment into a jelly-like mass that is difficult to process and can produce a non-uniform product with poor absorptivity and the like. The present invention employs large quantities of pigment (e.g. boehmite, pseudo-boehmite, or a mixture thereof) in combination with a highly-effective cationic polymeric ink fixative while avoiding the difficulties listed herein. The novel and unique manner in which this goal is accomplished will become readily apparent from the information provided below.

As previously stated, it is preferred that boehmite, pseudo-boehmite, or a mixture thereof be the sole pigment composition in the ink-receiving layer 30. In system containing boehmite, pseudo-boehmite, or a mixture thereof wherein other pigments are nonetheless employed in combination with such materials (namely, one or more of the supplemental pigment compositions recited above), it is preferred that the ink-receiving layer 30 contain at least about 50% by weight boehmite, pseudo-boehmite, or the chosen mixture of boehmite and pseudo-boehmite. The balance of the pigment supply will involve one or more supplemental pigment compositions as previously discussed. In such a "mixed" system, the total pigment supply will preferably contain about 50–90% by weight boehmite, pseudo-boehmite, or the selected combination thereof [optimum=about 60–80% by weight]. Regarding the supplemental pigment compositions listed above, the ink-receiving layer 30 (as a whole) will generally contain the following representative and non-limiting quantity of supplemental pigment compositions combined with the boehmite, pseudo-boehmite, or mixture thereof: about 0–30% by weight [optimum=about 5–20% by weight if the use of such supplemental pigment composition(s) is desired]. As previously stated, this value will involve the total (e.g. collective) amount of supplemental pigment composition(s) being used whether a single supplemental pigment composition is employed or multiple supplemental pigment compositions are used in combination.

Next, the ink-receiving layer 30 will employ a plurality of binders therein (e.g. at least one or more). While the present invention shall not be explicitly limited to any particular binder or binder combinations, it has been determined that the use of a special "binder blend" (also characterized herein as a "binder mixture", "binder combination", and the like which shall be considered equivalent phrases) offers certain important benefits. This is especially true when boehmite, pseudo-boehmite, or a mixture thereof is employed as the sole or predominant pigment composition in the ink-receiving layer 30. It should also be noted that the term "binder" as used throughout this discussion shall generally and traditionally involve compositions which have the ability to chemically, physically, and/or electrostatically retain one or more materials together in a given formulation or structure in order to provide mechanical strength, cohesiveness, and the like. Regarding the binder blend mentioned above, the following materials are considered to be preferred, optimum, and (in combination) capable of ensuring that the foregoing benefits are achieved (including superior water-fastness, a high degree of image stability, and the like):

1. "First Binder Composition" (or just "First Binder"): Polyvinyl alcohol—The basic structural formula for polyvinyl alcohol is as follows:

$$\text{-}(CH_2CHOH)_x\text{-}$$

[wherein x=about 1–3000 in a representative, non-limiting, and preferred embodiment].

This material is commercially available from numerous sources including but not limited to Nippon Gohsei of Osaka, Japan under the product designation "GOHSENOL NH-26" and Air Products and Chemicals, Inc. of Allentown, Pa. (USA) under the product designation/trademark "Airvol® 523". Exemplary and non-limiting derivatives of polyvinyl alcohol which may be encompassed within the term "polyvinyl alcohol" as used herein include but are not limited to unsubstituted polyvinyl alcohol as illustrated and discussed above, carboxylated polyvinyl alcohol, sulfonated polyvinyl alcohol, acetoacetylated polyvinyl alcohol, and mixtures thereof. Acetoacetylated polyvinyl alcohol has the following basic structural formula:

$$\text{-}(CH_2CHOH)_x\text{-}\mathbf{545}\ CH_2CHOCOCH_2COCH_3)_y\text{-}$$

[wherein x=about 1–3000 and y=about 1–100 in a representative, non-limiting, and preferred embodiment].

Acetoacetylated polyvinyl alcohol is commercially available from numerous sources including, for example, Nippon Gohsei of Osaka, Japan under the product designation "GOHSEFIMER Z 200". However, regarding the first binder composition, "straight" (e.g. unsubstituted) polyvinyl alcohol is preferred.

In an exemplary and non-limiting embodiment, the ink-receiving layer 30 will constitute about 1–15% by weight first binder composition (e.g. polyvinyl alcohol) [optimum=about 2.5–7% by weight] although these values are subject to change as needed and desired pursuant to preliminary pilot testing. The particular benefits provided by polyvinyl alcohol in the ink-receiving layer 30 as the first binder composition include but are not limited to the ability to provide a high degree of binding strength, color accuracy, and bleed control, as well as improved color gamut.

2. "Second Binder Composition" (or just "Second Binder"): In a preferred embodiment, the second binder composition will involve a poly(vinyl acetate-ethylene) copolymer (also known in an equivalent fashion as a polyvinyl acetate-polyethylene copolymer), with the term "copolymer" being defined above. The basic structural formula for this poly(vinyl acetate-ethylene) copolymer is as follows:

$$\text{-}(CH_2CHOCOCH_3)_x\text{-}(CH_2CH_2)_y\text{-}$$

[wherein x=about 250–32,000 and y=about 800–100,000 in a representative, non-limiting, and preferred embodiment].

This composition is commercially available from numerous sources including but not limited to Air Products and Chemicals, Inc. of Allentown, Pa. (USA) under the product designation/trademark "Airflex® 315". In an exemplary and non-limiting embodiment, the ink-receiving layer 30 will constitute about 1–15% by weight second binder composition (e.g. a poly(vinyl acetate-ethylene) copolymer) [optimum=about 5–10% by weight] although these values are subject to change as needed and desired pursuant to preliminary pilot testing. The particular benefits provided by the use of a poly(vinyl acetate-ethylene) copolymer in the ink-receiving layer 30 as the second binder composition include but are not limited to the ability to provide improved levels of binding strength, water durability, and coalescence reduction/control.

3. "Third Binder Composition" (or just "Third Binder"): In a preferred embodiment, the third binder composition will involve a poly(vinyl pyrrolidone-vinyl acetate) copolymer (also known in an equivalent fashion as a polyvinyl pyrrolidone-polyvinyl acetate copolymer), with the term "copolymer" again being defined above. The basic structural formula for this copolymer is as follows:

$$\text{-}(CH_2CH[\text{2-pyrrolidone}])_x\text{-}(CH_2CHOCOCH_3)_y\text{-}$$

[wherein x=about 500–15,000 and y=about 200–10,000 in a representative, non-limiting, and preferred embodiment].

This composition is commercially available from numerous sources including but not limited to Badische Anilin- & Soda-Fabrik Aktiengesellschaft (BASF) of Germany under the product designation "Luviskol® PVP/VA S-64W". In an exemplary and non-limiting embodiment, the ink-receiving layer 30 will constitute about 0.5–10% by weight third binder composition (e.g. a poly(vinyl pyrrolidone-vinyl acetate) copolymer) [optimum=about 0.5–3% by weight] although these values are subject to change as needed and desired pursuant to preliminary pilot testing. The particular benefits provided by the use of a poly(vinyl pyrrolidone-vinyl acetate) copolymer in the ink-receiving layer 30 as the third binder composition include but are not limited to the ability to provide an improved color gamut, better bleed performance, and greater color accuracy.

The particular materials listed above in connection with the first, second, and third binder compositions shall also be designated hereinafter as the "main" binders compared with the alternative/supplemental binder compositions recited below. In the ink-receiving layer 30, the total binder content (taking into account all of the various binders in combination) is preferably about 5–20% by weight [optimum=about 10–15% by weight]. These preferred and non-limiting values shall be considered applicable to the use of the main binders recited above without any other binder compositions, the main binders in combination with one or more alternative (e.g. supplemental) binders as discussed later in this section, and one or more alternative binders without any of the main binders. Likewise, the above ranges shall again involve the total (e.g. collective) amount of binder(s) being used whether a single binder composition is employed or multiple binders are used in combination. While it is preferred that the above-listed binder blend be employed which includes the first, second, and third binder compositions in combination, it is likewise possible to employ: (1) the first binder composition alone or combined with [i] the second binder composition, [ii] the third binder composition, [iii] one or more alternative binders as outlined below, or [iv] one or more alternative binders combined with either the second binder composition or the third binder composition; (2) the second binder composition alone or combined with [i] the first binder composition; [ii] the third binder composition; [iii] one or more alternative binders; or [iv] one or more alternative binders combined with either the first binder composition or the third binder composition; or (3) the third binder composition alone or combined with [i] the first binder composition; [ii] the second binder composition; [iii] one or more alternative binders; or [iv] one or more alternative binders combined with either the first binder composition or the second binder composition. However, employment of the novel binder blend listed above (namely, at least the first, second, and third binder compositions together) is highly effective and preferred.

It should also be understood that, while the above-listed binder blend constitutes a preferred embodiment having considerable novelty and importance, various other binders (one or more) can be used instead of the binder blend or in addition thereto (preferred) without limitation. Specifically, at least one alternative (e.g. "optional") organic or inorganic binder material can be added to any of the "main" binders recited above or used instead of such compositions (which is not necessarily preferred but is possible). The present invention shall not be restricted to any given alternative binder compositions, quantities thereof, or number of such binders which may be determined by routine preliminary experimentation. Representative and non-limiting examples of alternative binder compositions which may be employed in all embodiments of the ink-receiving layer 30 (and/or other layers in the print media product 10) include without limitation: starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl alcohol-ethylene oxide) copolymer, mixtures thereof, and others without restriction.

Representative polyurethanes that are suitable for use as alternative binder compositions alone or combined with other binder materials include but are not limited to the sub-class of compounds which would involve water-soluble or water-dispersible polyurethane polymers, water-soluble or water-dispersible modified polyurethane resin dispersions, and mixtures thereof. Of particular interest is the use of at least one modified polyurethane resin dispersion. The term "modified polyurethane resin dispersion" shall be generally defined herein to involve polyurethane polymers having hydrophobic groups associated therewith, wherein such materials are water-dispersible. While many different modified polyurethane resin dispersions are commercially available from numerous sources (and are typically proprietary in nature), a modified polyurethane resin dispersion that is appropriate for use as an alternative binder composition in the ink-receiving layer 30 alone or combined with the other binder materials set forth herein involves a product sold by Dainippon Ink and Chemicals/Dainippon International (USA), Inc. of Fort Lee, N.J. (USA) under the product designation "PATELACOL IJ-30". Further general information concerning this type of material (with particular reference to polyurethane dispersions/emulsions) is provided in Japanese Patent Publication No. 10-181189 which is incorporated herein by reference. However, other polyurethane-based materials shall also be appropriate for use as alternative binder compositions within the ink-receiving layer 30, with the above-listed composition being provided for example purposes only.

Regarding the employment of polyamide resins as alternative binder compositions alone or combined with other binders in the ink-receiving layer 30 (or other material layers discussed herein), the following chemicals can be encompassed within this class of compounds without limitation: acrylic modified polyamides, acrylic polyamide copolymers, methacrylic modified polyamides, cationic polyamides, polyquaternary ammonium polyamides, epichlorohydrin-containing polyamides, and mixtures thereof. One composition of particular interest within this group is an epichlorohydrin-containing polyamide. The term "epichlorohydrin-containing polyamide" shall be generally defined herein to involve an epichlorohydrin group-containing polyamide formulation, with this composition having the following basic structural/chemical formula:

$$(C_6H_{10}O_4.C_4H_{13}N_3.C_3H_5ClO)_x$$

[wherein x=about 1–1000 in a representative, preferred, and non-limiting formulation].

Epichlorohydrin-containing polyamides are commercially available from, for example, Georgia Pacific Resins, Inc. of Crossett, Ak. (USA) under the product designation "AMRES 8855".

Finally, regarding the use of a poly(vinyl alcohol-ethylene oxide) copolymer as an alternative binder composition in the ink-receiving layer 30 (or other layers in the print media product 10), this material has the following basic chemical/polymeric structure:

$$\text{-}(CH_2CHOH)_x(OCH_2CH_2)_y\text{-}$$

[wherein x=about 1000–8000, and y=about 10–500 in a representative, preferred, and non-limiting formulation].

It should be noted that the above-listed "x" and "y" values in this formula and the other formulae recited above are presented for example purposes only and constitute representative/preferred embodiments in a non-limiting fashion. These numbers are subject to change if needed and desired in accordance with routine preliminary testing. An exemplary poly(vinyl alcohol-ethylene oxide) copolymer which may be employed for the purposes listed herein is commercially available from, for example, Nippon Gohsei of Osaka, Japan under the product designation "WO-320".

If alternative binders such as those recited above are employed in combination with the main binders (namely, the claimed binder blend), such alternative binders shall be characterized herein for convenience purposes as "supplemental binder compositions" or "supplemental binders".

Regarding the alternative/supplemental binder compositions listed above (and others not specifically recited herein), the use of these materials in combination may involve many different quantity values without limitation. Likewise, the use of any given supplemental binders in combination with the main binders recited herein (namely, the first and second binder compositions) will result in a situation where the chosen quantity of supplemental binder compositions will correspondingly reduce (in a proportionate fashion) the amounts of the main binders. In this manner, the preferred total binder quantity values listed earlier in this discussion may be maintained. With continued reference to the use of supplemental binder compositions in combination with the main binders, the ink-receiving layer 30 will contain, for example, the following representative and non-limiting quantity of supplemental binder compositions: about 0–10% by weight [optimum=about 0.5–3% by weight if the incorporation of such supplemental binder(s) is desired]. These values will again involve the total (e.g. collective) amount of supplemental binder composition(s) being used whether a single supplemental binder is employed or multiple supplemental binders are used in combination.

Next, at least one or more compositions generally designated herein as "supplemental ingredients" can be incorporated within the ink-receiving layer 30. All of these materials should be considered "optional" in nature and can be omitted entirely although it is preferred that at least one or more of them be used. These supplemental ingredients include but are not restricted to:

1. Lactic Acid: This material (which generally involves the formula: $C_3H_6O_3$) can be used to aid in dispersing the pigment composition (with particular reference to the use of boehmite, pseudo-boehmite, or a mixture thereof as the sole or predominant pigment composition). A representative and non-limiting quantity of lactic acid which may be employed within the ink-receiving layer 30 (if the use of this material is desired) involves about 0.5–4% by weight of the layer 30 [optimum=about 1–2% by weight of the layer 30].

2. At least one compound which is characterized herein as a "defoamer composition". This material may be employed during fabrication of the ink-receiving layer 30 in order to reduce and otherwise eliminate the formation of undesired foam (e.g. bubbles) in the mixture of materials that will ultimately become the ink-receiving layer 30. The use of at least one defoamer composition can therefore avoid the presence of bubbles and/or air-pockets within the completed ink-receiving layer 30. The defoamer compositions of interest in the current invention also perform a surfactant function and, accordingly, the phrase "defoamer composition" should be broadly construed to encompass at least one or more surfactants.

Exemplary commercially-available products (some or all of which may be considered to have proprietary formulations) which can be used as defoamer compositions in the ink-receiving layer 30 include but are not limited to the following materials: [A] an oil-based product sold by Henkel KGaA of Germany under the product designation/trademark: "Foammaster VFS"; [B] an oil-based product sold by Cognis Corporation of Cincinnati, Ohio (USA) under the product designation/trademark "Foamstar® A12"; and [C] a non-ionic surfactant-type product sold by Air Products and Chemicals, Inc. of Allentown, Pa. (USA) under the product designation/trademark "Surfynol®420".

A single defoamer composition or multiple defoamer compositions can be employed in combination when producing the ink-receiving layer 30. In this regard, the present invention shall not be restricted to any particular defoamer composition types, amounts, or combinations. If it is desired that one or more defoamer compositions be included in the completed ink-receiving layer 30, the layer 30 will contain in a representative embodiment about 0.02–2% by weight defoamer composition therein [optimum=about 0.1–1% by weight]. These quantity values shall again be construed to involve the total (e.g. collective) amount of defoamer composition(s) being used whether a single defoamer is employed or multiple defoamers are used in combination. In a still further exemplary embodiment, the following defoamer composition blend can be employed in order to attain a high degree of foam-control (with the following percentage values involving % by weight of the completed ink-receiving layer 30): [i] about 0.02–1% by weight defoamer composition "A" recited above [optimum=about 0.02–0.1% by weight]; [ii] about 0.02–1% by weight defoamer composition "B" recited above [optimum=about 0.02–0.04% by weight]; and [iii] about 0.1–1% by weight defoamer composition "C" recited above [optimum=about 0.1–0.5% by weight] in combination. It is particularly desirable that the above-listed numbers be chosen so that the total defoamer composition quantity will fall within the foregoing preferred or optimum ranges pertaining to the total defoamer composition content. This particular blend is being provided for example purposes only and shall not limit the invention in any respect.

3. At least one compound designated herein as a "slip agent". This material can be used in the ink-receiving layer 30 in order to provide numerous benefits. These benefits include, for instance, a reduction in the surface friction levels of the completed ink-receiving layer 30 in order to make it smoother and more readily moveable through the printer unit(s) of interest. A variety of different commercially-available compositions can be employed for this purpose including those sold under the "Slip-Ayd®" trademark by Elementis Specialties of Heightstown, N.J. (USA) with particular reference to, for example, a compound bearing the product designation/trademark "SL 1618". This material basically involves an oxidized polyethylene composition. Other slip agents that can be used alone or in combination with each other (and the SL 1618 material recited above) include, for instance, polytetrafluoroethylene beads which are commercially available from, for instance, Shamrock Technologies, Inc. of Newark, N.J. (USA) under the product designation/trademark "Fluoro AQ-50". Regarding the quantity of slip agent to be included within the ink-receiving layer 30, the present invention shall not be limited to any particular numerical amounts. However, in a preferred and non limiting embodiment, the ink-receiving layer 30 will contain about 0.25–5% by weight slip agent [optimum=about 0.5–2% by weight] if it is desired that a slip agent be used. Again, these quantity values shall be construed to involve the total (e.g. collective) amount of slip agent(s) being employed whether a single slip agent or multiple slip agents in combination are used.

Various other supplemental ingredients can be incorporated within the ink-receiving layer 30 in addition to or instead of those recited above without limitation including biocides, UV/light protectants, fade-control agents, fillers, preservatives (e.g. antioxidants), buffers, and the like in varying amounts as determined by routine preliminary pilot analysis. Accordingly, the claimed invention shall not be restricted to any given supplemental ingredients or amounts thereof.

Next, the ink-receiving layer 30 preferably includes therein at least one ink fixative, with the term "ink fixative" being generally defined herein to involve a material which chemically, physically, or electrostatically binds with or otherwise fixes the ink materials of interest to, within, or on the ink-receiving layer 30. This material is used in order to further foster a high degree of water-fastness, smear-fastness, and overall image stability. To accomplish this goal in the past, cationic polymeric dye fixatives had been considered for the above-listed purpose. However, the use of these materials presented a considerable challenge in that, when combined with colloidal pigments such as boehmite and/or pseudo-boehmite (which are of primary interest in this case as the pigments of choice), undesired gellation and/or viscosity increases (also known as "viscosification") of the pigments occurred. This situation substantially hindered the overall production process and made it difficult to fabricate a smooth, uniform, and functionally-effective ink-receiving layer 30 having the desired characteristics set forth above. Likewise, these problems had the potential to create considerable manufacturing inefficiencies which prevented the ink-receiving layers from being produced in a rapid and economical fashion.

To avoid the difficulties listed above, two basic approaches were considered, with each having particular disadvantages. The first approach involved employment of the cationic polymeric dye fixative in a separate and distinct layer apart from the layer containing the pigment materials (with particular reference to boehmite and/or pseudo-boehmite). This approach increased the overall complexity of the media product and required the use of an additional material layer which resulted in higher manufacturing costs. In addition, the multi-layer approach discussed above increased the overall quality control requirements associated with the product since an additional layer (and fabrication procedure associated therewith) was necessary. A second approach was reviewed in which the overall solids-content of the material mixture used to produce the ink-receiving layer was maintained at a low level during production (e.g. less than about 20% by weight total solids). The term "solids-content" as used herein shall again be construed to involve the total amount of solid material in the mixture or composition of interest relative to the liquid components thereof (whether aqueous or non-aqueous). By maintaining a low solids-content (with minimal quantities of pigment), cationic polymeric dye fixatives could be used while at least partially avoiding pigment gellation and viscosification problems.

However, in fabricating ink-receiving layers of the type described herein, it is often desirable to produce layer structures which contain large amounts of solids (namely, substantial quantities of pigment with particular reference to boehmite and/or pseudo-boehmite). Ink-receiving layers with considerable quantities of pigment therein (especially boehmite, pseudo-boehmite, or a mixture thereof) are highly porous. This situation typically results in improved ink-absorbing capacity, greater water-fastness, and better overall image permanence. However, the production of ink-receiving layers having these characteristics (namely, a high pigment content) has been hindered by the particular chemical characteristics of the ink fixatives discussed above which dictate that a low solids-content coating mixture be produced (in order to avoid pigment gellation and/or viscosification). Thus, prior to the current invention, the desire for an ink-receiving layer containing large amounts of pigment could not be effectively reconciled with the use of a cationic polymeric ink fixative (which, itself, was desirable in accordance with its effective image-stabilizing characteristics).

The present invention involves an important and unique development in which an ink-receiving layer 30 is provided as described herein which includes (1) a cationic polymeric ink fixative; and (2) large quantities of pigment (e.g. boehmite and/or pseudo-boehmite) together within the ink-receiving layer 30. Specifically, the present invention employs at least one special ink fixative (which is combined with the pigment) that effectively accomplishes the goals listed above, namely, high pigment levels and the use of an effective polymer-based ink fixative. The ink fixative of interest in this case involves at least one cationic emulsion polymer which is especially compatible with the pigment (preferably a material selected from the group consisting of boehmite, pseudo-boehmite, and a mixture thereof). As a result of this compatibility, inducement (by the ink fixative) of gellation and increases in viscosity of the pigment is substantially avoided during fabrication of the ink-receiving layer 30 and thereafter. Furthermore, in accordance with the foregoing development, the ink-receiving layer 30 will optimally include therein at least about 65% by weight boehmite, pseudo-boehmite, a mixture thereof, and/or other pigment(s) as discussed above. This situation is made possible through the compatibility of the pigment (e.g. boehmite, pseudo-boehmite, and combinations of such materials) with the chosen cationic emulsion polymer.

It should be noted that the use of "substantially" regarding the avoidance of gellation and viscosification problems as outlined above shall be construed to involve a situation in which the foregoing problems are avoided to a degree sufficient to allow a smooth, uniform, and effective ink-receiving layer 30 with a high degree of porosity to be obtained at the pigment and solids levels described herein (or other levels which may be chosen using preliminary pilot testing). Such an ink-receiving layer 30 would contain the pigments and ink fixatives therein together and would not require the use of separate layers for each ingredient. Employment of the term "substantially" in the manner discussed above is therefore being used to account for the fact that any gellation and/or viscosification of the pigment which might nonetheless occur in accordance with the inherent uncertainties in all chemical processes will only involve negligible levels which would not prevent the benefits listed above from being obtained when the present invention is implemented.

As previously stated, the term "cationic emulsion polymer" shall be generally defined herein for the purposes of this invention to involve a polymer produced through an emulsion polymerization process that contains at least one monomer that is cationic in nature (e.g. positively-charged) such as a protonated amine (e.g. a primary, secondary, or tertiary amine) or a quaternized (e.g. quaternary) amine. Representative quaternary amine cationic monomers include but are not limited to trimethylammonium ethyl acrylate chloride, trimethylammonium ethyl acrylate methyl sulfate, benzyldimethylammonium ethyl acrylate chloride, benzyldimethylammonium ethyl acrylate methyl sulfate, benzyldimethylammonium ethyl methacrylate chloride, and benzyldimethylammonium ethyl methacrylate methyl sulfate. A cationic emulsion polymer of particular interest which is especially effective in offering the above-mentioned benefits comprises a quaternary amine cationic emulsion polymer as noted above (also designated herein in abbreviated form as a "quaternary amine emulsion polymer"). In general, quaternary amine compounds basically involve compounds that contain four alkyl and/or aryl groups (all the same, different, or mixtures thereof without limitation) that are bound to a central nitrogen atom. The term "quaternary amine emulsion polymer" shall be construed to encompass cationic emulsion polymers as previously defined which contain at least one quaternary amine compound or group.

An exemplary and preferred quaternary amine emulsion polymer which may be employed as the cationic emulsion polymer ink fixative in the ink-receiving layer 30 involves a proprietary composition that is commercially available from the Rohm and Haas Company of Philadelphia, Pa. (USA) under the product designation/trademark "Primal® PR-26". This material is especially effective and useful in providing the above-listed benefits (namely, the avoidance of gellation and/or viscosification problems when relatively large amounts of pigment materials such as boehmite and/or pseudo-boehmite are employed). The benefits offered by the above-listed composition result at least partially from the fact that it has a high glass transition temperature ($T_g$) [e.g. the temperature at which a liquid changes to a glass-like solid composition] and/or a high crosslinking capability. Specific characteristics of the "Primal® PR-26" composition include an acrylic polymer content of about 27–29% by weight, an alkylaryl polyether alcohol content of about 2–4% by weight, a water content of about 69–70% by weight, a pH of 7.0–8.0, a solids content of about 30.0–31.0% by weight, a viscosity of about 200–800 cps, and a weight per gallon of about 8.9 lb./gal. Additional information regarding quaternary amine cationic emulsion polymers is provided in, for example, U.S. Pat. No. 5,312,863 which is incorporated herein by reference.

In a preferred embodiment, the ink-receiving layer 30 will comprise about 1–30% by weight [optimum=about 10–20% by weight] of the chosen ink fixative, namely, the cationic emulsion polymer(s) with particular reference to the use of a quaternary amine emulsion polymer such as the Primal® PR-26 composition. As previously noted, this value will involve the total (e.g. collective) amount of ink fixative(s)/cationic emulsion polymer(s) being used whether a single compound is employed or multiple compositions are used in combination. It should also be understood that the claimed invention shall not be limited to any single cationic emulsion polymer (or quaternary amine emulsion polymer), with a variety of materials in these classes (alone or combined) being suitable for use herein provided that they have the functional capabilities recited above. These capabilities again include a high degree of compatibility with the pigment (especially boehmite and/or pseudo-boehmite). The term "compatibility" primarily involves the ability of the chosen polymer to avoid gellation and/or viscosification reactions with the pigment at the quantity levels recited above or others as chosen using routine preliminary testing (including but not limited to about 65% by weight or more).

It should also be noted that, expressed in a different manner, the present invention shall likewise be construed to cover a specialized fluidic (e.g. "fluid-containing") coating formulation that is used to produce the novel ink-receiving layer 30. This coating formulation will include, at the very least, at least one liquid carrier medium (e.g. water, organic solvents, or mixtures thereof with water as the sole carrier medium being preferred), at least one binder, and at least one pigment composition (preferably boehmite, pseudo-boehmite, or a mixture thereof as the sole pigment material in the formulation). Representative binders, pigments, and other ingredients suitable for employment in the coating formulation are discussed above in connection with the ink-receiving layer 30 and are incorporated in the current discussion by reference. Regarding the liquid carrier medium, it is preferably about 50–100% by weight water [optimally about 80–100% by weight water], with the balance involving organic solvents such as n-methyl pyrrolidone, 2-propanol, butanol, and mixtures thereof without limitation. The coating formulation will have a solids-content (as previously defined) of at least about 20% by weight or more, with a preferred range being about 20–45% by weight [optimum=about 25–40% by weight]. These % by weight values will involve the total amount of solids in the entire fluid-containing coating formulation (e.g. wet weight). Furthermore, the coating formulation will include the cationic emulsion polymer recited above, namely, a particular cationic emulsion polymer which is compatible with the pigment (e.g. boehmite and/or pseudo-boehmite) and substantially avoids the inducement of gellation and increases in viscosity with respect to the pigment. As previously noted, at least one quaternary amine emulsion polymer is preferred for this purpose (the Primal® PR-26 composition, for example). Using this approach, the desired solids-content of at least about 20% by weight may be achieved in the coating formulation.

While a specific cationic emulsion polymer has been recited above in accordance with a preferred embodiment of the invention, it shall again be understood that other cationic emulsion polymers are prospectively applicable to this invention provided that they are capable of performing in the manner summarized above. Specifically, such materials will have the common ability to be chemically compatible with the chosen pigment (especially boehmite, pseudo-boehmite, or a mixture thereof) in that they will substantially avoid the gellation and/or viscosification problems discussed herein. This aspect of the current invention therefore represents an important development in the print media field. In particular, it enables a specialized print media product 10 to be fabricated which employs a highly effective cationic emulsion polymer ink fixative while simultaneously permitting the use of large pigment quantities without gellation and/or viscosification problems. As a result, an ink-receiving layer 30 may be fabricated which includes, for instance, at least about 65% by weight boehmite, pseudo-boehmite, or a mixture thereof which is highly porous, ink-absorbent, and capable of producing stable and water-fast printed images.

A number of different techniques may be employed to apply, form, or otherwise deliver the ink-receiving layer 30 in position over and above the substrate 12 (and/or coating layer 20 associated therewith if present). Formation of the ink-receiving layer 30 is typically accomplished by coating the substrate 12 (and/or coating layer 20 if used) with the fluidic coating composition (discussed above). The coating composition will again contain all of the above-listed ingredients (incorporated in the current description by reference) and will optimally have a solids-content of at least about 20% by weight. A number of different delivery/coating methods may be implemented for this purpose including but not limited to the use of a conventional slot-die processing system, meyer bar apparatus, curtain coating system, rod coating device, brush delivery applicator, or other comparable techniques/devices including those that employ circulating and non-circulating coating technologies. An exemplary coating weight range associated with the ink-receiving layer 30 (irrespective of the coating method that is employed) is about 5–13 g/m$^2$ [optimum=about 8–10 g/m$^2$] with reference to the completed (e.g. dried) layer 30. However, the claimed invention and its various embodiments shall not be restricted to any particular layer application/formation methods (and coating weights) with a number of different alternatives being employable.

Once the above-listed coating composition is applied to the substrate 12/coating layer 20 (if used), it shall be characterized hereinafter as the ink-receiving layer 30. After this step, the substrate 12 having the layer 30 thereon is preferably dried. This may be accomplished by heating the substrate 12/layer 30 combination at a preferred and non-limiting temperature of about 80–120° C. [optimum=about 90–110° C.] within a conventional oven-type heating apparatus of a variety normally used for fabricating sheet-type print media products, with the foregoing substrate 12/layer 30 combination moving through the heating apparatus at a representative "web speed" of about 500–2000 ft./minute [optimum=about 1500–2000 ft./minute]. However, it shall also be understood that other drying methods may be employed without limitation provided that the compositions associated with layer 30 are effectively dried at this stage. The overall thickness of the print media product 10 illustrated schematically in FIG. 2 may readily be determined by simply adding up all of the above-listed thickness values "T", "$T_1$", and "$T_2$" associated with the substrate 12, coating layer 20 (if used), and ink-receiving layer 30, respectively. The total thickness of the print media product 10 can, of course, be appropriately varied depending on the number of any additional layers that may be employed within the print media product 10.

Figure 3:
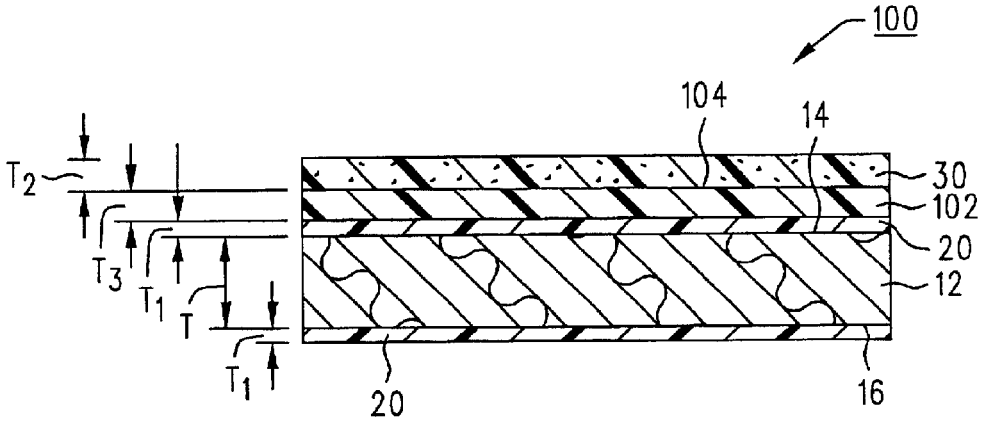
FIG. 3 is a schematically-illustrated and enlarged partial cross-sectional view of a completed print media product produced in accordance with a novel and preferred alternative embodiment of the invention illustrating the material layers and thicknesses associated therewith.

As stated throughout the current discussion, a variety of different versions of this invention are possible provided that at least one ink-receiving layer 30 is used which contains the material combinations listed above. This layer 30 may be located anywhere on or within the print media product 10, provided that it is able to receive at least some of the ink materials being delivered. At this point, an alternative embodiment of the invention will now be discussed. This embodiment will involve all of the information, materials, numerical parameters, thickness values, fabrication techniques, definitions, procedures, and other items mentioned above in connection with all of the structures of the first embodiment shown in FIG. 2. Thus, all of these items are incorporated in the current discussion by reference unless otherwise expressly stated herein and will therefore not be repeated. In fact, the only difference between the embodiment of FIG. 2 and the embodiment which will now be discussed (as illustrated in FIG. 3) involves the placement of at least one additional layer of material between the ink-receiving layer 30 as previously described and the upper surface 14 of the substrate 12 if uncoated (or the coating layer 20 on the upper surface 14 if coated). Component numbers carried forward from one embodiment to another (namely, from the embodiment of FIG. 2 to the embodiment of FIG. 3) shall represent structures which are common to all embodiments.

As previously mentioned, the print media product 10 may contain at least one additional layer of material (also known as an "additional material layer") located above or below the ink-receiving layer 30. A non-limiting example of a print media product 100 which employs an additional layer of material is schematically illustrated in FIG. 3. This additional material layer (likewise characterized herein as a "medial layer" or "intermediate layer" in the embodiment of FIG. 3) is shown at reference number 102. With reference to FIG. 3, it is positioned over and above (e.g. operatively attached to) the upper surface 14 of the substrate 12 (with or without the coating layer 20 thereon) and is therefore "supported" by the substrate 12 as previously defined. In a preferred (but not necessarily required) embodiment, the additional material layer 102 is "directly affixed" to the upper surface 14/coating layer 20. This phrase is defined to involve direct attachment of such components to each other without any intervening materials or layers therebetween. Likewise, the ink-receiving layer 30 is positioned over and above (e.g. "supported" by as previously defined) the top or upper surface 104 of the additional material layer 102 with "direct affixation" of such components being preferred (although not required). It should also be understood that further layers of material (not shown) may be located below the additional material layer 102 (between the layer 102 and substrate 12 whether coated or uncoated) or above the additional material layer 102 (between the layer 102 and ink-receiving layer 30) without limitation. A representative and non-limiting thickness value "$T_4$" associated with the additional material layer 102 will be about 1–50 $\mu$m [optimum=about 10–40 $\mu$m].

The additional material layer 102 may be made from a number of different compositions including but not limited to pigment compositions, binders, fillers, defoamer compositions, lubricants, UV/light stabilizers, biocides, buffers, fade-control agents, lactic acid, preservatives (e.g. antioxidants), general stabilizers, and the like alone or combined without restriction. In particular, all of the ingredients recited above in connection with the ink-receiving layer 30 may also be employed within the additional material layer 102 alone or in various combinations without limitation regarding the number, type, and quantity thereof. It is preferred (but not necessarily required) that the additional material layer 102 include (at a minimum) at least one pigment composition and at least one binder. Exemplary pigments will comprise those listed above in connection with the ink-receiving layer 30, namely, silica (in precipitated, colloidal, gel, sol, and/or fumed form), cationic-modified silica (e.g. alumina-treated silica in an exemplary and non-limiting embodiment), cationic polymeric binder-treated silica, magnesium oxide, magnesium carbonate, calcium carbonate, boehmite, pseudo-boehmite, barium sulfate, clay, titanium dioxide, gypsum, plastic-type pigments, mixtures thereof, and others without limitation.

Representative binders suitable for use in the additional material layer 102 will also involve those listed herein with respect to the ink-receiving layer 30 including but not limited to polyvinyl alcohol and derivatives thereof, starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl alcohol-ethylene oxide) copolymer, a poly(vinyl acetate-ethylene) copolymer, a poly (vinyl pyrrolidone-vinyl acetate) copolymer, mixtures thereof, and others. The additional material layer 102 can also include at least one ink fixative of the type discussed above (e.g. a cationic emulsion polymer with particular but not necessarily exclusive reference to the preferred composition recited herein) or other ink fixatives if needed and desired. Again, all of the information provided above involving construction materials, ingredient quantities, and the like in connection with the ink-receiving layer 30 is incorporated by reference regarding the additional material layer 102. For example, the total amount of pigment and binder that were previously listed in connection with the ink-receiving layer 30 shall be applicable to the additional material layer 102 in a preferred embodiment. In this regard, the additional material layer 102 may contain a total (e.g. "collective" as previously defined) amount of pigment equal to about 65–90% by weight of the layer 102 [optimum=about 65–75% by weight], with the total (e.g. "collective") quantity of binder being equal to about 5–20% by weight of the layer 102 [optimum=about 10–15% by weight]. These values are subject to change as needed and may be proportionately reduced or adjusted to account for the incorporation of other materials including ink fixatives, surfactants, and the like. Instead of reducing the amounts of both the pigment(s) and binder(s), either one of the pigment(s) or binder(s) could be reduced in quantity on an individual basis to account for the added ingredient(s) if desired. Likewise, the additional material layer 102 can involve the use of at least one pigment (without any binders), at least one binder (without any pigments), or other combinations of materials.

A number of different methods may be employed to apply, form, or otherwise deliver the compositions associated with additional material layer 102 in position over and above the substrate 12 (and/or coating layer 20 if present). Representative application techniques which can be chosen for this purpose include but are not limited to the use of a slot-die processing system, meyer bar apparatus, curtain coating system, rod coating device, brush delivery applicator or other comparable methods including those that employ circulating and non-circulating coating technologies. An exemplary coating weight range associated with the additional material layer 102 (irrespective of the coating method that is employed) is about 17–27 g/m$^2$ [optimum=about 20–24 g/m$^2$] with reference to the completed (e.g. dried) layer 102. However, the claimed invention and its various embodiments shall not be restricted to any particular layer application/formation methods (and coating weights) with a number of different alternatives being employable for this purpose. Once the materials which are used to form the additional material layer 102 are applied to the substrate 12 (and coating layer 20 if used), such materials shall be characterized hereinafter as the additional material layer 102. After this step, the substrate 12 having the additional material layer 102 thereon is preferably dried. This may be accomplished by heating the substrate 12/layer 102 combination at a preferred and non-limiting temperature of about 80–120° C. [optimum=about 90–110° C.] within a conventional oven-type heating apparatus of a variety normally used for fabricating sheet-type print media products, with the foregoing substrate 12/layer 102 combination moving through the heating apparatus at a representative "web speed" of about 500–2000 ft./minute [optimum=about 1500–2000 ft./minute]. However, other drying methods may be employed without limitation provided that the compositions associated with additional material layer 102 are effectively dried at this stage.

Thereafter, the ink-receiving layer 30 can be applied, delivered, or otherwise formed onto the top surface 104 of the additional material layer 102 so that it is operatively attached thereto. This step may be accomplished using the techniques, methods, operational parameters, web speeds, coating weights, and other information (including drying steps, temperatures, and the like) which are listed above in connection with the ink-receiving layer 30. Such information shall therefore be incorporated in the current discussion by reference.

At this point, the basic manufacturing process is completed regarding all of the embodiments recited herein. From a physical, chemical, and structural standpoint, the ink-receiving layer 30 produced in accordance with the invention can be expected in most cases to have the following important characteristics: an average drying time of less than about 1 minute, a porosity of about 0.15–0.3 cc/g, and a specular gloss of about 50 at 60° (as measured by a Micro-TRI-Gloss meter [P/N GB4520] from BYK Gardner USA of Columbia, Md. [USA]), with the foregoing numerical parameters being non-limiting but preferred.

The following specific Examples are provided as preferred versions of the claimed print media product 10 that are designed to deliver optimum results. It shall be understood that the recitation of these Examples will not limit the invention in any respect.

EXAMPLE 1

In this Example (which corresponds to the print media product 10 of FIG. 2), the substrate 12 is constructed from a commercial paper product that is pre-coated on both surfaces/sides 14, 16 with a coating layer 20 which is comprised of a proprietary binder/pigment mixture. The pre-coated paper product which is used as the substrate 12 in this example was obtained from the Westvaco Corporation of New York, N.Y. (USA). The thickness values and coating weights associated with the substrate 12, coating layer 20, and ink-receiving layer 30 are within the numerical ranges specified above. No other ink receiving layers (or layers of any other kind) were employed in this Example.

| Ink-Receiving Layer 30 | |
|---|---|
| Component | % By Dry Weight in Layer |
| Boehmite-containing pigment ["Catapal ® 200" as discussed above] | 71.18 |
| Lactic Acid | 1.4 |
| First Defoamer Composition ["Foammaster VFS" as discussed above] | 0.03 |
| Second Defoamer Composition ["Foamstar ® A12" as discussed above] | 0.02 |
| Third Defoamer Composition ["Surfynol ® 420" as discussed above] | 0.11 |
| Slip Agent [oxidized polyethylene - "Slip-Ayd ® 1618" as discussed above] | 0.93 |
| Polyvinyl alcohol [First Binder Composition] | 2.85 |
| Poly(vinyl acetate-ethylene) copolymer [Second Binder Composition] | 7.12 |
| Poly(vinyl pyrrolidone-vinyl acetate) copolymer [Third Binder Composition] | 2.13 |
| Ink fixative [quaternary amine emulsion polymer - "Primal ® PR-26" as discussed above] | 14.23 |
| | 100 |

EXAMPLE 2

In this Example (which corresponds to the print media product 100 of FIG. 3), all of the information provided above in connection with EXAMPLE 1 is applicable thereto except as otherwise indicated below. The only difference involves the inclusion of additional material layer 102 between the substrate 12/coating layer 20 and the ink-receiving layer 30.

Ink-Receiving Layer 30

See the information listed above in connection with EXAMPLE 1 regarding the ink-receiving layer 30 which is fully applicable to EXAMPLE 2

| Additional Material Layer 102 | |
|---|---|
| Component | % By Dry Weight in Layer |
| Silica (Pigment) | 77 |
| Polyvinyl alcohol (Binder) | 23 |
| | 100 |

In summary and from a general standpoint, the basic method of interest which is applicable to all of the foregoing embodiments will generally involve the following steps: (1) providing a substrate; (2) forming an ink-receiving layer in position over and above the substrate (whether coated or uncoated) or, more generally, operatively attaching the ink-receiving layer to the substrate so that the ink-receiving layer is "supported" by the substrate. The ink receiving layer can involve all of the particular formulations listed above in connection with ink-receiving layer 30 illustrated in the drawing figures, with such formulations being incorporated by reference in the current discussion with respect to the claimed methods. Likewise, as previously noted, the term "forming" as used in the claimed methods shall be construed in the broadest sense possible and will generally signify the creation and placement (as a whole) of the completed (e.g. dried) ink-receiving layer 30 on the substrate 12/coating layer 20 (if used).

Figure 4:
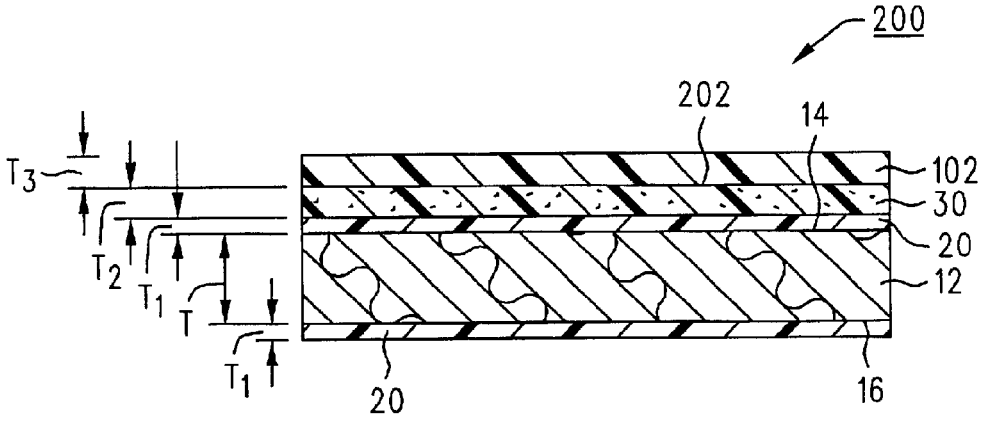
FIG. 4 is a schematically-illustrated and enlarged partial cross-sectional view of a completed print media product produced in accordance with a novel and preferred further alternative embodiment of the invention illustrating the material layers and thicknesses associated therewith.

In a still further embodiment as outlined above, the print media product 10 may be provided with at least one additional layer of material (also known as an "additional material layer") thereon or therein (see the embodiments of FIGS. 3–4). For example, in order to produce the embodiment of FIG. 3, the following step is undertaken: placing (or "forming" which shall be considered equivalent to "placing") at least one additional or intermediate layer of material (e.g. additional material layer 102) in position over and above the substrate 12/coating layer 20 prior to application of the ink-receiving layer 30. This step specifically involves placing the additional material layer 102 between the substrate 12/coating layer 20 (if used) and the ink-receiving layer 30 so that the additional material layer 102 is operatively attached to both the substrate 12/coating layer 20 and the ink-receiving layer 30. The additional material layer 102 can encompass all of the particular formulations listed above in connection with this structure, with such formulations being incorporated herein by reference in the current discussion.

An even further embodiment is illustrated in FIG. 4 which includes all of the information, materials, parameters, data, construction methods, and the like that pertain to the previously-described embodiments of FIGS. 1–3 which are incorporated by reference in connection with the embodiment of FIG. 4 and thus will not be repeated. The only difference between the embodiments of FIGS. 3 and 4 is the layer-order with respect to the ink-receiving layer 30 and additional material layer 102. In the print media product 200 of the FIG. 4, additional material layer 102 is on top (e.g. is the "outermost" material layer) while, in the print media product 100 of FIG. 3, the ink-receiving layer 30 is on top (e.g. "outermost"). Specifically, as shown in FIG. 4, the additional material layer 102 is positioned over and above (e.g. "operatively attached to") the top surface 202 of the ink-receiving layer 30. Everything else in connection with the embodiments of FIGS. 3 and 4 is the same. In order to produce the embodiment of FIG. 4, the following step is undertaken: placing (or "forming" which shall be considered equivalent to "placing") at least one additional layer of material (e.g. additional material layer 102) in position over and above the ink-receiving layer 30. Both of the embodiments of FIGS. 3–4 may, if desired, include even further layers in a variety of locations without limitation.

Having set forth herein preferred embodiments of the invention, it is anticipated that various modifications may be made thereto by individuals skilled in the relevant art which nonetheless remain within the scope of the invention. For example, the invention shall not be limited to any particular ink delivery systems, operational parameters, numerical values, dimensions, ink compositions, layering arrangements, print media components, substrates, material proportions/quantities, and component orientations unless otherwise explicitly stated herein. The present invention shall therefore only be construed in accordance with the following claims:

The invention that is claimed is:

1. A print media product comprising:

a substrate; and at least one ink-receiving layer supported by said substrate, said ink-receiving layer being comprised of:

at least one pigment composition comprised of a material selected from the group consisting of boehmite, pseudo-boehmite, and a mixture thereof, said material being present in said ink-receiving layer in an amount equal to at least about 65% by weight of said ink-receiving layer; and a plurality of binders, said plurality of binders comprising a first binder composition comprised of polyvinyl alcohol, a second binder composition comprised of a poly (vinyl acetate-ethylene) copolymer, and a third binder composition comprised of a poly (vinyl pyrrolidone-vinyl acetate) copolymer.

2. The print media product of claim 1 wherein said print media product further comprises at least one additional material layer.

3. A print media product comprising:

a substrate; and at least one ink-receiving layer supported by said substrate, said ink-receiving layer being comprised of:

at least one pigment composition comprised of a material selected from the group consisting of boehmite, pseudo-boehmite, and a mixture thereof, said material being present in said ink-receiving layer in an amount equal to at least about 65% by weight of said ink-receiving layer; and at least one ink fixative in combination with said pigment composition in said ink-receiving layer, said ink fixative comprising at least one cationic emulsion polymer which is compatible with said material selected from the group consisting of boehmite, pseudo-boehmite, and a mixture thereof and substantially avoids inducement of gellation and increases in viscosity of said material so that said ink-receiving layer may be comprised of at least about 65% by weight of said material.

4. The print media product of claim 3 wherein said ink-receiving, layer comprises about 1–30% by weight said cationic emulsion polymer.

5. The print media product of claim 3 wherein said cationic emulsion polymer comprises a quaternary amine emulsion polymer.

6. The print media product of claim 3 wherein said ink-receiving layer further comprises a plurality of binders, said plurality of binders comprising a first binder composition comprised of polyvinyl alcohol, a second binder composition comprised of a poly(vinyl acetate-ethylene) copolymer, and a third binder composition comprised of a poly(vinyl pyrrolidone-vinyl acetate) copolymer.

7. The print media product of claim 3 wherein said print media product further comprises at least one additional material layer.

8. A print media product comprising:

a substrate; and at least one ink-receiving layer supported by said substrate, said ink-receiving layer being comprised of:

at least one pigment composition comprised of a material selected from the group consisting of boehmite, pseudo-boehmite, and a mixture thereof;

a plurality of binders, said plurality of binders comprising a first binder composition comprised of polyvinyl alcohol, a second binder composition comprised of a poly(vinyl acetate-ethylene) copolymer, and a third binder composition comprised of a poly (vinyl pyrrolidone-vinyl acetate) copolymer; and at least one ink fixative comprised of at least one cationic emulsion polymer.

9. The print media product of claim 8 wherein said cationic emulsion polymer comprises a quaternary amine emulsion polymer.

10. The print media product of claim 8 wherein said print media product further comprises at least one additional material layer.

11.A print media product comprising:

a substrate; and at least one ink-receiving layer supported by said substrate, said ink-receiving layer being comprised of:

about 65–90% by weight of a material selected from the group consisting of boehmite, pseudo-boehmite, and a mixture thereof;

about 1–15% by weight of a first binder composition comprised of polyvinyl alcohol;

about 1–15% by weight of a second binder composition comprised of a poly(vinyl acetate-ethylene) copolymer about 0.5–10% by weight of a third binder composition comprised of a poly (vinyl pyrrolidone-vinyl acetate) copolymer;

about 1–30% by weight of at least one cationic emulsion polymer;

about 0.02–2% by weight of at least one defoamer composition;

about 0.5–4% by weight lactic acid; and about 0.25–5% by weight of at least one slip agent.

12. A coating formulation for use in preparing an ink-receiving layer, said coating formulation comprising at least one liquid carrier medium, at least one binder, and at least one pigment composition comprised of a material selected from the group consisting of boehmite, pseudo-boehmite, and a mixture thereof, said coating formulation having a solids content of at least about 20% by weight, said coating formulation further comprising at least one ink fixative, said ink fixative comprising at least one cationic emulsion polymer which is compatible with said material selected from the group consisting of boehmite, pseudo-boehmite, and a mixture thereof and substantially avoids inducement of gellation and increases in viscosity of said material so that said solids content of at least about 20% by weight may be present in said coating formulation.

13. The coating formulation of claim 12 wherein said cationic emulsion polymer comprises a quaternary amine emulsion polymer.

14. A method for producing a print media product comprising:

providing a substrate; and forming at least one ink-receiving layer in position over and above said substrate, said ink-receiving layer being comprised of:

at least one pigment composition comprised of a material selected from the group consisting of boehmite, pseudo-boehmite, and a mixture thereof, said material being present in said ink-receiving layer in an amount equal to at least about 65% by weight of said ink-receiving layer; and a plurality of binders, said plurality of binders comprising a first binder composition comprised of polyvinyl alcohol, a second binder composition comprised of a poly(vinyl acetate-ethylene) copolymer, and a third binder composition comprised of a poly (vinyl pyrrolidone-vinyl acetate) copolymer.

15. The method of claim 14 further comprising providing said print media product with at least one additional material layer.

16. A method for producing a print media product comprising:

providing a substrate; and forming at least one ink-receiving layer in position over and above said substrate, said ink-receiving layer being comprised of:

at least one pigment composition comprised of a material selected from the group consisting of boehmite, pseudo-boehmite, and a mixture thereof, said material being present in said ink-receiving layer in an amount equal to at least about 65% by weight of said ink-receiving layer; and at least one ink fixative in combination with said pigment composition in said ink-receiving layer, said ink fixative comprising at least one cationic emulsion polymer which is compatible with said material selected from the group consisting of boehmite, pseudo-boehmite, and a mixture thereof and substantially avoids inducement of gellation and increases in viscosity of said material so that said ink-receiving layer may be comprised of at least about 65% by weight of said material.

17. The method of claim 16 further comprising providing said print media product with at least one additional material layer.

18. A method for producing a print media product comprising:

providing a substrate; and forming at least one ink-receiving layer in position over and above said substrate, said ink-receiving layer being comprised of:

at least one pigment composition comprised of a material selected from the group consisting of boehmite, pseudo-boehmite, and a mixture thereof;

a plurality of binders, said plurality of binders comprising a first binder composition comprised of polyvinyl alcohol, a second binder composition comprised of a poly(vinyl acetate-ethylene) copolymer, and a third binder composition comprised of a poly (vinyl pyrrolidone-vinyl acetate) copolymer; and at least one ink fixative comprised of at least one cationic emulsion polymer.

19. The method of claim 18 further comprising providing said print media product with at least one additional material layer.

20. A method for producing a print media product comprising:

providing a substrate; and forming at least one ink-receiving layer in position over and above said substrate, said ink-receiving layer being comprised of:

about 65–90% by weight of a material selected from the group consisting of boehmite, pseudo-boehmite, and a mixture thereof;

about 1–15% by weight of a first binder composition comprised of polyvinyl alcohol;

about 1–15% by weight of a second binder composition comprised of a poly(vinyl acetate-ethylene) copolymer about 0.5–10% by weight of a third binder composition comprised of a poly(vinyl pyrrolidone-vinyl acetate) copolymer;

about 1–30% by weight of at least one cationic emulsion polymer;

about 0.02–2% by weight of at least one defoamer composition;

about 0.5–4% by weight lactic acid; and about 0.25–5% by weight of at least one slip agent.

21. A print media product comprising:

a substrate; and at least one ink-receiving layer supported by said substrate, said ink-receiving layer being comprised of:

at least one pigment composition comprised of a material selected from the group consisting of boehmite, pseudo-boehmite, and a mixture thereof, said material being present in said ink-receiving layer in an amount equal to at least about 65% by weight of said ink-receiving layer;

at least one ink fixative in combination with said pigment composition in said ink-receiving layer, said ink fixative comprising at least one quaternary amine emulsion polymer which is compatible with said material selected from the group consisting of boehmite, pseudo-boehmite, and a mixture thereof and substantially avoids inducement of gellation and increases in viscosity of said material so that said ink-receiving layer may be comprised of at least about 65% by weight of said material, said ink-receiving layer comprising about 1–30% by weight of said quaternary amine emulsion polymer; and a plurality of binders, said plurality of binders comprising a first binder composition comprised of polyvinyl alcohol, a second binder composition comprised of a poly(vinyl acetate-ethylene) copolymer, and a third binder composition comprised of a poly (vinyl pyrrolidone-vinyl acetate) copolymer.

* * * * *